US008762159B2

(12) United States Patent
Geiger et al.

(10) Patent No.: US 8,762,159 B2
(45) Date of Patent: Jun. 24, 2014

(54) AUDIO ENCODER, AUDIO DECODER, ENCODED AUDIO INFORMATION, METHODS FOR ENCODING AND DECODING AN AUDIO SIGNAL AND COMPUTER PROGRAM

(75) Inventors: Ralf Geiger, Erlangen (DE); Jeremie Lecomte, Fuerth (DE); Markus Multrus, Nuremberg (DE); Max Neuendorf, Nuremberg (DE); Christian Spitzner, Nuremberg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/191,246

(22) Filed: Jul. 26, 2011

(65) Prior Publication Data

US 2012/0022881 A1 Jan. 26, 2012

Related U.S. Application Data

(63) Continuation of application No. PCT/EP2010/050998, filed on Jan. 28, 2010.

(60) Provisional application No. 61/147,887, filed on Jan. 28, 2009.

(51) Int. Cl.
*G10L 21/00* (2013.01)

(52) U.S. Cl.
USPC ..... 704/504; 704/500; 704/501; 704/502; 704/503

(58) Field of Classification Search
USPC ..... 704/500–504
See application file for complete search history.

(56) References Cited

U.S. PATENT DOCUMENTS

| | | | | |
|---|---|---|---|---|
| 7,395,211 | B2 * | 7/2008 | Watson et al. | 704/500 |
| 2006/0031064 | A1 * | 2/2006 | Liljeryd et al. | 704/219 |
| 2006/0147124 | A1 * | 7/2006 | Edler et al. | 382/260 |
| 2007/0009033 | A1 | 1/2007 | Liebchen | |

(Continued)

FOREIGN PATENT DOCUMENTS

| | | |
|---|---|---|
| EP | 00910900 | 10/2002 |
| EP | 2015293 | 1/2009 |

(Continued)

OTHER PUBLICATIONS

Kim, et al., "Proposed syntax revision regarding window sequence on USAC RM0", 87. MPEG Meeting; Feb. 2, 2009-Jun. 2, 2009; Lausanne; (Motion Picture Expert Group or ISO/IEC JTC1/SC29/WG11),, No. M16125, Jan. 29, 2009, XP030044722.

*Primary Examiner* — Leonard Saint Cyr
(74) *Attorney, Agent, or Firm* — Michael A. Glenn; Perkins Coie LLP

(57) ABSTRACT

An audio decoder for providing a decoded audio information on the basis of an encoded audio information includes a window-based signal transformer configured to map a time-frequency representation, which is described by the encoded audio information, to a time-domain representation. The window-based signal transformer is configured to select a window, out of a plurality of windows including windows of different transition slopes and windows of different transform length, on the basis of a window information. The audio decoder includes a window selector configured to evaluate a variable-codeword-length window information in order to select a window for a processing of a given portion of the time-frequency representation associated with a given frame of the audio information.

21 Claims, 21 Drawing Sheets

(56) References Cited

U.S. PATENT DOCUMENTS

| | | | | |
|---|---|---|---|---|
| 2007/0180980 | A1* | 8/2007 | Kim | 84/612 |
| 2008/0097749 | A1* | 4/2008 | Xie et al. | 704/200.1 |
| 2009/0012797 | A1* | 1/2009 | Boehm et al. | 704/501 |
| 2009/0040997 | A1* | 2/2009 | Oh et al. | 370/345 |

FOREIGN PATENT DOCUMENTS

| | | |
|---|---|---|
| JP | 07-236144 | 9/1995 |
| JP | 3171598 | 3/2001 |
| KR | 20000023674 | 4/2000 |
| WO | WO-98/02971 | 1/1998 |

* cited by examiner

| FIGURE 1 | |
|---|---|
| FIGURE 1A | FIGURE 1B |

| FIGURE 1 | |
|---|---|
| FIGURE 1A | FIGURE 1B |

| FIGURE 2 | |
|---|---|
| FIGURE 2A | FIGURE 2B |

| FIGURE 2 | |
|---|---|
| FIGURE 2A | FIGURE 2B |

Window Sequences and Transform windows

| Value | Window | #coeffs |
|---|---|---|
| 0 | ONLY_LONG_SEQUENCE =LONG_WINDOW | 1024/960 |
| 1 | LONG_START_SEQUENCE =LONG_START_WINDOW | 1024/960 |
| 2 | EIGHT_SHORT_SEQUENCE =8*SHORT_WINDOW | 8*(128/120) |
| 3 | LONG_STOP_SEQUENCE =LONG_STOP_WINDOW | 1024/960 |
| 1 | STOP_START_SEQUENCE =STOP_START_WINDOW | 1024/960 |
| 3 | STOP_1152_SEQUENCE =STOP_WINDOW_1152 optional | 1152/1080 |
| 1 | STOP_START_1152_SEQUENCE =STOP_START_WINDOW_1152 optional | 1152/1080 |

| FIGURE 3 | |
|---|---|
| FIGURE 3A | FIGURE 3B |

FIGURE 3A

| FIGURE 3 | |
|---|---|
| FIGURE 3A | FIGURE 3B |

- Allowed Window Sequences

| window sequence<br>to →<br>from ↓ | ONLY_LONG_SEQUENCE | LONG_START_SEQUENCE | EIGHT_SHORT_SEQUENCE | LONG_STOP_SEQUENCE | STOP_START_SEQUENCE | LPD_SEQUENCE optional | STOP_1152_SEQUENCE optional | STOP_START_1152_SEQUENCE optional |
|---|---|---|---|---|---|---|---|---|
| ONLY_LONG_SEQUENCE | ☑ | ☑ | | | | | | |
| LONG_START_SEQUENCE | | | ☑ | ☑ | ☑ | ☑ | | |
| EIGHT_SHORT_SEQUENCE | | | ☑ | ☑ | ☑ | ☑ | | |
| LONG_STOP_SEQUENCE | ☑ | ☑ | | | | | | |
| STOP_START_SEQUENCE | | | ☑ | ☑ | ☑ | ☑ | | |
| LPD_SEQUENCE optional | | | | | | ☑ | ☑ | ☑ |
| STOP_1152_SEQUENCE optional | ☑ | ☑ | | | | | | |
| STOP_START_1152_SEQUENCE optional | | | ☑ | ☑ | ☑ | ☑ | | |

FIGURE 4 optional 620 624 table 630 optional

| | proposed syntax | | | | current syntax | | |
|---|---|---|---|---|---|---|---|
| previous core mode is **LPD** | window_length of previous frame | window_length of current frame | transform_length of current frame | core_mode of following frame | window_sequence of previous frame | window_sequence of current frame | name of **window_squence** in USAC |
| 0 | 0 | 0 | not transmitted (=0) | — | 0 or 3 | 0 | ONLY_LONG_SEQUENCE |
| 0 | 0 | 1 | 0 (or not transmitted) | 0 | 0 or 3 | 1 | LONG_START_SEQUENCE |
| 0 | 0 | 1 | 0 (or not transmitted) | 1 | 0 or 3 | 3 | LPD_START_SEQUENCE |
| 0 | 1 | 0 | not transmitted (=0) | — | 1 or 2 | 3 | LONG_STOP_SEQUENCE |
| 0 | 1 | 1 | 0 | — | 1 or 2 | 1 | STOP_START_SEQUENCE |
| 0 | 1 | 1 | 1 | — | 1 or 2 | 2 | EIGHT_SHORT_SEQUENCE |
| 1 | not transmitted (=1) | 0 | not transmitted (=0) | — | LPD | 3 | STOP_1152_SEQUENCE |
| 1 | not transmitted (=1) | 1 | 0 | — | LPD | 1 | STOP_START_1152_SEQUENCE |

optional optional

FIGURE 6A

| | window_type of current frame | window_length of current frame (660) | transform_length of current frame (662) | number of window_type bits included into bitstream (664) |
|---|---|---|---|---|
| | ONLY_LONG_SEQUENCE | 0 | not transmitted | 1 |
| | LONG_START_SEQUENCE* | 1 | 0 (or not transmitted) | 2 (optionally: 1) |
| | LONG_STOP_SEQUENCE | 0 | not transmitted | 1 |
| | STOP_START_SEQUENCE* | 1 | 0 | 2 |
| | EIGHT_SHORT_SEQUENCE* | 1 | 1 | 2 |
| optional | STOP_1152_SEQUENCE | 0 | not transmitted | 1 |
| optional | STOP_START_1152_SEQUENCE* | 1 | 0 (or not transmitted) | 2 (optionally: 1) |

* may optionally be adapted, if current frame is followed by LPD frame

FIGURE 6B

| previous core mode | **window_length** of previous frame | **window_length** of current frame | **transform_length** of current frame | **window_type** of current frame |
|---|---|---|---|---|
| FD | 0 | 0 | not evaluated (or set to default value) | ONLY_LONG_SEQUENCE |
| FD | 0 | 1 | not evaluated (or set to default value) | LONG_START_SEQUENCE* |
| FD | 1 | 0 | not evaluated (or set to default value) | LONG_STOP_SEQUENCE |
| FD | 1 | 1 | 0 | STOP_START_SEQUENCE* |
| FD | 1 | 1 | 1 | EIGHT_SHORT_SEQUENCE* |
| LPD | not evaluated (or set to default value) | 0 | not evaluated (or set to default value) | STOP_1152_SEQUENCE |
| LPD | not evaluated (or set to default value) | 1 | not evaluated (or set to default value) | STOP_START_1152_SEQUENCE* |

optional

* may optionally be adapted, if current frame is followed by LPD frame

FIGURE 6C

Syntax of window_length

| window_length | length of right window slope |
|---|---|
| 0 | 1024 |
| 1 | 128 |

FIGURE 7A

Syntax of transform_length

| transform_length | MDCT kernel size |
|---|---|
| 0 | 1024/1152 |
| 1 | 128 |

FIGURE 7B

New bit stream syntax and transition

| window_length | length of right window slope | transform_length | length of transform |
|---|---|---|---|
| 0 | 1024 | 0 (not transmitted) | 1024 or 1152 |
| *0* | *1024* | *1 (not possible)* | |
| 1 | 128 | 0 | 1024 or 1152 |
| 1 | 128 | 1 | 128 |

FIGURE 7C

Overview over all combinations of window_length and transform_length

| window_length of previous frame | window_length of current frame | transform_length of current frame | core_mode of following frame | value of window_sequence |
|---|---|---|---|---|
| 0 | 0 | 0 | — | 0 |
| — | 1 | 0 | 0 | 1 |
| — | 1 | 0 | 1 | 3 |
| — | 1 | 1 | — | 2 |
| 1 | 0 | 0 | — | 3 |

FIGURE 8

Bit saving evaluation

| nominal bit rate | No of transform_length bit saved / total no of FD frames (%) | No of transform_length bit saved / total no of all frames (%) | totsl bit rate reduction (bit/s) |
|---|---|---|---|
| all_mono.wav | | | |
| 12 kbps | 95,67 | 35,12 | 4,41 |
| 16 kbps | 96,54 | 35,49 | 5,01 |
| 20 kbps | 97,18 | 54,78 | 8,60 |
| 24 kbps | 96,86 | 54,58 | 9,14 |
| all_stereo.wav | | | |
| 16 kbps | 95,89 | 36,39 | 5,15 |
| 20 kbps | 97,23 | 55,76 | 8,76 |
| 24 kbps | 96,70 | 55,40 | 9,29 |
| 32 kbps | 95,65 | 54,80 | 10,75 |
| 64 kbps | 95,15 | 95,15 | 22,41 |

FIGURE 9

```
usac_raw_data-block ()
{
    single_channel_element (); and/or
    channel_pair_element ();

}
```

FIGURE 10A

Syntax of single_channel_element()

| Syntax | No. of bits | Mnemonic |
|---|---|---|
| single_channel_element() | | |
| { | | |
| **core_mode** | **1** | **uimsbf** |
| if ( core_mode == 1 ) { | | |
| lpd_channel_stream(); | | |
| } | | |
| else{ | | |
| fd_channel_stream(); | | |
| } | | |
| } | | |

FIGURE 10B

Syntax of channel_pair_element()

| Syntax | No. of bits | Mnemonic |
|---|---|---|
| channel_pair_element() | | |
| { | | |
| **core_mode0** | **1** | **uimsbf** |
| **core_mode1** | **1** | **uimsbf** |
| ics_info(); optional: common ics_info for two channels | | |
| if ( core_mode0 == 1 ) { | | |
| lpd_channel_stream(); | | |
| } | | |
| else{ | | |
| fd_channel_stream(); | | |
| } | | |
| if ( core_mode1 == 1 ) { | | |
| lpd_channel_stream(); | | |
| } | | |
| else{ | | |
| fd_channel_stream(); | | |
| } | | |
| } | | |

FIGURE 10C

Syntax of ics_info()

| Syntax | No. of bits | Mnemonic |
|---|---|---|
| ics_info() | | |
| { | | |
| **window_legth:** | 1 | uimsbf |
| if ( window_length != 0) { | | |
| **transform_legth:** | 1 | uimsbf |
| } | | |
| else{ | | |
| transform_length=0; | | |
| } | | |
| **window_shape:** | 1 | uimsbf |
| if ( window_length != 0 && transform_length !=0 ) { | | |
| **max_sfb;** | 4 | uimsbf |
| **scale_factore_grouping;** | 7 | uimsbf |
| } | | |
| else{ | | |
| **max_sfb;** | 6 | uimsbf |
| } | | |
| } | | |

optional

FIGURE 10D

Syntax of fd_channel_stream()

| Syntax | | No. of bits | Mnemonic |
|---|---|---|---|
| fd_channel_stream() | | | |
| { | | | |
| **global_gain;** | | **8** | **uimsbf** |
| ics_info (); | (unless included in channel pair element) | | |
| scale_factor_data (); | | | |
| ac_spectral_data (); | | | |
| } | | | |

FIGURE 10E

AUDIO ENCODER, AUDIO DECODER, ENCODED AUDIO INFORMATION, METHODS FOR ENCODING AND DECODING AN AUDIO SIGNAL AND COMPUTER PROGRAM

CROSS-REFERENCE TO RELATED APPLICATIONS

This application is a continuation of copending International Application No. PCT/EP2010/050998, filed Jan. 28, 2010, which is incorporated herein by reference in its entirety, and additionally claims priority from U.S. Application No. 61/147,887, filed Jan. 28, 2009, which is also incorporated herein by reference in its entirety.

BACKGROUND OF THE INVENTION

Embodiments according to the invention are related to an audio encoder for providing an encoded audio information on the basis of an input audio information and to an audio decoder for providing a decoded audio information on the basis of an encoded audio information. Further embodiments according to the invention are related to an encoded audio information. Yet further embodiments according to the invention are related to a method for providing a decoded audio information on the basis of an encoded audio information and to a method for providing an encoded audio information on the basis of an input audio information. Further embodiments are related to computer programs for performing the inventive methods.

An embodiment of the invention is related to a proposed update on a unified-speech-and-audio-coding (USAC) bitstream syntax.

In the following, some background of the invention will be explained in order to facilitate the understanding of the invention and the advantages thereof. During the past decade, big effort has been put on creating the possibility to digitally store and distribute audio contents. One important achievement on this way is the definition of the international standard ISO/IEC 14496-3. Part 3 of this standard is related to an encoding and decoding of audio contents, and subpart 4 of part 3 is related to general audio coding. ISO/IEC 14496 part 3, subpart 4 defines a concept for encoding and decoding of general audio content. In addition, further improvements have been proposed in order to improve the quality and/or reduce the useful bit rate.

However, according to the concept described in said standard, a time domain audio signal is converted into a time-frequency representation. The transform from the time domain to the time-frequency domain is typically performed using transform blocks, which are also designated as "frames" of time domain samples. It has been found that it is advantageous to use overlapping frames, which are shifted, for example, by half a frame, because the overlap allows to efficiently avoid (or at least reduce) artifacts. In addition, it has been found that a windowing should be performed in order to avoid the artifacts originating from this processing of temporally limited frames. Also, the windowing allows for an optimization of an overlap-and-add process of subsequent temporally shifted but overlapping frames.

However, it has been found that it is problematic to efficiently represent edges, i.e. sharp transitions or so-called transients within the audio content, using windows of uniform length, because the energy of a transition will be spread out over the entire duration of a window, which results in audible artifacts. Accordingly, it has been proposed to switch between windows of different lengths, such that approximately stationary portions of an audio content are encoded using long windows, and such that transitional portions (e.g. portions comprising a transient) of the audio content are encoded using shorter windows.

However, in a system, which allows to choose between different windows for transforming an audio content from the time domain to the time-frequency domain, one may of course signal to a decoder which window should be used for a decoding of an encoded audio content of a given frame.

In conventional systems, for example in an audio decoder according to the international standard ISO/IEC 14496-3, part 3, subpart 4, a data element called "window_sequence", which indicates the window sequence used in the current frame, is written with two bits into a bitstream in a so-called "ics_info" bitstream element. By taking the window sequence of the previous frame into account, eight different window sequences are signaled.

In view of the above discussion, it can be seen that a bit load of the encoded bitstream representing an audio information is created by the need to signal the type of window used.

In view of this situation, there is the desire to create a concept which allows for a more bitrate-efficient signaling of a type of window used for a transform between a time domain representation of an audio content and a time-frequency domain representation of the audio content.

SUMMARY

According to an embodiment, an audio decoder for providing a decoded audio information on the basis of an encoded audio information may have: a window-based signal transformer configured to map a time-frequency representation of the audio information, which is described by the encoded audio information, to a time-domain representation of the audio information, wherein the window-based signal transformer is configured to select a window, out of a plurality of windows having windows of different transition slopes and windows having associated therewith different transform lengths using a window information; wherein the audio decoder has a window selector configured to evaluate a variable-codeword-length window information in order to select a window for a processing of a given portion of the time-frequency representation associated with a given frame of the audio information.

According to another embodiment, an audio encoder for providing an encoded audio information on the basis of an input audio information may have: a window-based signal transformer configured to provide a sequence of audio signal parameters on the basis of the plurality of windowed portions of the input audio information, wherein the window-based signal transformer is configured to adapt window types for acquiring the windowed portions of the input audio information in dependence on characteristics of the input audio information; wherein the window-based signal transformer is configured to switch between a usage of windows having a longer transition slope and windows having a shorter transition slope, and to also switch between a usage of windows having two or more different transform lengths; and wherein the window-based signal transformer is configured to determine a window type used for transforming a current portion of the input audio information in dependence on a window type used for transforming a preceding portion of the input audio information and an audio content of the current portion of the input audio information; wherein the audio encoder is configured to encode a window information describing a type of window used for transforming the current portion of the input audio information using a variable-length-codeword.

According to another embodiment, an encoded audio information may have: an encoded time-frequency representation describing an audio content of a plurality of windowed portions of an audio signal, wherein windows of different transition slopes and different transform lengths are associated with different of the windowed portions of the audio signal; and an encoded window information encoding types of windows used for acquiring the encoded time-frequency representation of a plurality of windowed portions of the audio signal, wherein the encoded window information is a variable-length window information encoding one or more types of windows using a first, lower number of bits and encoding one or more other types of windows using a second, larger number of bits.

According to another embodiment, a method for providing a decoded audio information on the basis of an encoded audio information may have the steps of: evaluating a variable-codeword-length window information in order to select a window, out of a plurality of windows having windows of different transition slopes and windows having associated therewith different transform lengths, for processing a given portion of a time-frequency representation associated with a given frame of the audio information; and mapping the given portion of the time-frequency representation, which is described by the encoded audio information, to a time-domain representation using the selected window.

According to another embodiment, a method for providing an encoded audio information on the basis of an input audio information may have the steps of: providing a sequence of audio signal parameters on the basis of a plurality of windowed portions of the input audio information, wherein a switching is performed between a usage of windows having a longer transition slope and windows having a shorter transition slope, and also between a usage of windows having associated therewith two or more different transform lengths, to adapt window types for acquiring the windowed portions of the input audio information in dependence on characteristics of the input audio information; and encoding an information describing types of windows used for transforming portions of the input audio information using variable-length-codewords.

Another embodiment may have a computer program for performing the method for providing a decoded audio information on the basis of an encoded audio information, which method may have the steps of: evaluating a variable-codeword-length window information in order to select a window, out of a plurality of windows having windows of different transition slopes and windows having associated therewith different transform lengths, for processing a given portion of a time-frequency representation associated with a given frame of the audio information; and mapping the given portion of the time-frequency representation, which is described by the encoded audio information, to a time-domain representation using the selected window, when the computer program runs on a computer.

Another embodiment may have a computer program for performing the method for providing an encoded audio information on the basis of an input audio information, which method may have the steps of: providing a sequence of audio signal parameters on the basis of a plurality of windowed portions of the input audio information, wherein a switching is performed between a usage of windows having a longer transition slope and windows having a shorter transition slope, and also between a usage of windows having associated therewith two or more different transform lengths, to adapt window types for acquiring the windowed portions of the input audio information in dependence on characteristics of the input audio information; and encoding an information describing types of windows used for transforming portions of the input audio information using variable-length-codewords, when the computer program runs on a computer.

An embodiment according to the invention creates an audio decoder for providing a decoded audio information on the basis of an encoded audio information. The audio decoder comprises a window-based signal transformer configured to map a time-frequency representation, which is described by the encoded audio information, to a time-domain representation of the audio content. The window-based signal transformer is configured to select a window out of a plurality of windows comprising windows of different transition slopes and windows of different transform lengths, on the basis of a window information. The audio decoder comprises a window selector configured to evaluate a variable-codeword-length window information in order to select a window for a processing of a given portion (e.g. frame) of the time-frequency representation associated with a given frame of the audio information.

This embodiment of the invention is based on the finding that a bitrate that may be used for storing or transmitting an information indicating which type of window should be used for transforming a time-frequency-domain representation of an audio content to a time-domain representation can be reduced by using a variable-codeword-length window information. It has been found that a variable-codeword-length window information is well-suited because the information needed to select the appropriate window is well-suited for such a variable-codeword-length representation.

For example, by using a variable-codeword-length window information, it can be exploited that there is a dependency between a selection of a transition slope and a selection of a transform length, because a short transform length will typically not be used for a window having one or two long transition slopes. Accordingly, a transmission of redundant information can be avoided by using a variable-codeword-length window information, thereby improving the bitrate-efficiency of the encoded audio information.

As a further example, it should be noted that there is typically a correlation between window shapes of adjacent frames, which can also be exploited for selectively reducing a codeword-length of the window information for cases in which the window type of one more adjacent windows (adjacent to the currently considered window) limit a choice of window types for the current frame.

To summarize the above, the usage of a variable-codeword-length window information allows for a saving of bitrate without significantly increasing a complexity of the audio decoder and without altering an output wave form of the audio decoder (when compared to a constant-codeword-length window information). Also, the syntax of the encoded audio information may even be simplified in some cases, as will be discussed in detail later on.

In an advantageous embodiment, the audio decoder comprises a bitstream parser configured to parse a bitstream representing the encoded audio information and to extract from the bitstream a one-bit window-slope-length information and to selectively extract, in dependence on a value of the one-bit window-slope-length information, from the bitstream a one-bit transform-length information. In this case, the window selector is advantageously configured to selectively, in dependence on the window-slope-length information, use or neglect the transform-length information in order to select a window for a processing of a given portion of the time-frequency representation.

By using this concept, a separation between the window-slope-length information and the transform-length information can be obtained, which contributes to a simplification of the mapping in some cases. Also, a split-up of the window information into a compulsory window-slope-length bit and a transform-length bit, the presence of which is dependent on the state of the window-slope-length bit, allows for a very efficient reduction of the bitrate, which can be obtained while keeping the syntax of the bitstream sufficiently simple. Accordingly, the complexity of the bitstream parser is kept sufficiently small.

In an advantageous embodiment, the window selector is configured to select a window type for processing a current portion of the time-frequency information (for example, a current audio frame) in dependence on a window type selected for the processing of a previous portion (for example, a previous audio frame) of the time-frequency information, such that a left-sided window-slope-length of the window for processing the current portion of the time-frequency information is matched to a right-sided window-slope-length of the window selected for processing the previous portion of the time-frequency information. By exploiting this information, a bitrate that may be used for selecting a window type for processing of the current portion of the time-frequency information is particularly small, as the information for selecting a window type is encoded with particularly low complexity. In particular, it is not necessary to "waste" a bit for encoding a left-sided window-slope-length of the window associated with the current portion of the time-frequency information. Accordingly, by using the information about a right-sided window-slope-length used for a processing of a previous portion of the time-frequency information, two bits (for example, the compulsory window-slope-length bit and the facultative transform-length bit) can be used to select an appropriate window out of a plurality of more than four selectable windows. Thus, unnecessary redundancy is avoided, and the bitrate-efficiency of the encoded bitstream is improved.

In an advantageous embodiment, the window selector is configured to select between a first type of window and a second type of window in dependence on a value of a one-bit window-slope-length information, if a right-sided window-slope-length of the window for processing the previous portion of the time-frequency information takes a "long" value (indicating a comparatively longer window-slope-length when compared to a "short" value indicating a comparatively shorter window-slope-length) and if a previous portion of the time-frequency information, a current portion of the time-frequency information and a subsequent portion of the time-frequency information are all encoded in a frequency-domain core mode.

The window selector is advantageously also configured to select a third type of window in response to a first value (for example, a value of "one") of the one-bit window-slope-length information, if a right-sided window-slope-length of the window for processing the previous portion of the time-frequency information takes a "short" value (as discussed above), and if a previous portion of the time-frequency information, a current portion of the time-frequency information and a subsequent portion of the time-frequency information are all encoded in a frequency-domain core mode.

Furthermore, the window selector is advantageously also configured to select between a fourth type of window and a window sequence (which may be considered as a fifth type of window) in dependence on a one-bit-transform-length information, if the one-bit window-slope-length information takes a second value (e.g. a value of "zero") indicating a short right-sided window slope, and if the right-sided window-slope-length of the window for processing the previous portion of the time-frequency information takes a "short" value (as discussed above), and if the previous portion of the time-frequency information, the current portion of the time-frequency information and the subsequent portion of the time-frequency information are all encoded in a frequency-domain core mode.

For this case, the first type of window comprises a (comparatively) long left-sided window-slope-length, a (comparatively) long right-sided window-slope-length and a (comparatively) long transform length, the second type of window comprises a (comparatively) long left-sided window-slope-length, a (comparatively) short right-sided window-slope-length and a (comparatively) long transform length, the third type of window comprises a (comparatively) short left-sided window-slope-length, a (comparatively) long right-sided window-slope-length and a (comparatively) long transform length, and the fourth type of window comprises a (comparatively) short left-sided window-slope-length, a (comparatively) short right-sided window-slope-length and a (comparatively) long transform length. The "window sequence" (or fifth window type) defines a sequence or superposition of a plurality of sub-windows associated to a single portion (for example, frame) of the time-frequency information, each of the plurality of sub-windows having a (comparatively) short transform length, a (comparatively) short left-sided window-slope-length and a (comparatively) short right-sided window-slope-length. By using such an approach, a total of five window types (including the type "window sequence") can be selected using only two bits, wherein a single-bit information (namely the one-bit window-slope-length information) is sufficient for signaling the very common sequence of a plurality of windows having comparatively long window-slope-lengths both on the left side and on the right side. In contrast, a two-bit window information may only be used in preparation of a sequence of short windows ("window sequence" or "fifth type of window") and during a temporally extended (across a plurality of frames) series of "window sequence" frames.

To summarize, the above described concept of selecting a type of window out of a plurality of, for example, five different types of windows allows for a strong reduction of the bitrate that may be used. While, conventionally, three dedicated bits would be used to select a type of window out of, for example, five types of windows, only one or two bits may be used in accordance with the present invention to perform such a selection. Thus, a significant saving of bits can be achieved, thereby reducing the bitrate that may be used and/or providing the chance to improve the audio quality.

In an advantageous embodiment, the window selector is configured to selectively evaluate a transform-length bit of the variable-codeword-length window information only if a window type for a processing of a previous portion (e.g. frame) of the time-frequency information comprises a right-sided window-slope-length matching a left-sided window-slope-length of a short-window-sequence and if a one-bit window-slope-length information associated with the current portion (e.g. current frame) of the time-frequency information defines a right-sided window-slope-length matching the right-sided window-slope-length of the short-window-sequence.

In an advantageous embodiment, the window selector is further configured to receive a previous core mode information associated with a previous portion (e.g. frame) of the audio information and describing a core mode used for encoding the previous portion (e.g. frame) of the audio information. In this case, the window selector is configured to select a window for a processing of a current portion (for example, frame) of the time-frequency representation in dependence on the previous core mode information and also in dependence on the variable-codeword-length window information associated to the current portion of the time-frequency representation. Thus, the core mode of a previous frame can be exploited to select an appropriate window for a transition (for example in the form of an overlap-and-add operation) between the previous frame and the current frame. Again, the usage of a variable-codeword-length window information is very advantageous, because it is again possible to save a significant number of bits. A particularly good saving can be obtained if the number of window types, which is available (or valid) for an audio frame encoded, for example, in a linear-prediction-domain, is small. Thus, it is often possible to use a short codeword, out of a longer codeword and a shorter codeword, at a transition between two different core modes (e.g. between a linear-prediction-domain core mode and a frequency-domain core mode).

In an advantageous embodiment, the window selector is further configured to receive a subsequent core mode information associated with a subsequent portion (or frame) of the audio information and describing a core mode used for encoding the subsequent frame of the audio information. In this case, the audio selector is advantageously configured to select a window for a processing of a current portion (for example, frame) of the time-frequency representation in dependence on the subsequent core mode information and also in dependence on the variable-codeword-length window information associated to the current portion of the time-frequency representation. Again, the variable-codeword-length window information can be exploited, in combination with the subsequent core mode information, in order to determine the type of window with a low bit-count requirement.

In an advantageous embodiment, the window selector is configured to select windows having a shortened right-sided slope, if the subsequent core mode information indicates that a subsequent frame of the audio information is encoded using a linear-prediction-domain core mode. In this way, an adaptation of the windows to a transition between the frequency-domain core mode and the time-domain core mode can be established without requiring extra signaling effort.

Another embodiment according to the invention creates an audio encoder for providing an encoded audio information on the basis of an input audio information. The audio encoder comprises a window-based signal transformer configured to provide a sequence of audio signal parameters (for example, a time-frequency-domain representation of the input audio information) on the basis of a plurality of windowed portions (e.g. overlapping or non-overlapping frames) of the input audio information. The window-based signal transformer is advantageously configured to adapt a window shape for obtaining the windowed portions of the input audio information in dependence on the characteristics of the input audio information. The window-based signal transformer is configured to switch between a usage of windows having a (comparatively) longer transition slope and windows having a (comparatively) shorter transition slope, and also switch between a usage of windows having two or more different transform lengths. The window-based signal transformer is also configured to determine a window type used for transforming a current portion (for example, frame) of the input audio information in dependence on a window type used for transforming a preceding portion (e.g. frame) of the input audio information and an audio content of the current portion of the input audio information. Also, the audio encoder is configured to encode a window information describing a type of window used for transforming a current portion of the input audio information using a variable-length codeword. This audio encoder provides for the advantages already discussed with reference to the inventive audio decoder. In particular, it is possible to reduce the bitrate of the encoded audio information by avoiding the usage of a comparatively long codeword in some or all of the situations in which this is possible.

Another embodiment according to the invention creates an encoded audio information. The encoded audio information comprises an encoded time-frequency representation describing an audio content of a plurality of windowed portions of an audio signal. Windows of different transition slopes (e.g. transition-slope-lengths) and different transform lengths are associated with different of the windowed portions of the audio signal. The encoded audio information also comprises an encoded window information encoding types of windows used for obtaining the encoded time-frequency representations of a plurality of windowed portions of the audio signal. The encoded window information is a variable-length window information encoding one or more types of windows using a first, lower number of bits and encoding one or more other types of windows using a second, larger number of bits. This encoded audio information brings along the advantages already discussed above with respect to the inventive audio decoder and the inventive audio encoder.

Another embodiment according to the invention creates a method for providing a decoded audio information on the basis of an encoded audio information. The method comprises evaluating a variable-codeword-length window information in order to select a window, out of a plurality of windows comprising windows of different transition slopes (for example different transition-slope-lengths) and windows of different transformation lengths, for a processing of a given portion of the time-frequency representation associated with a given frame of the audio information. The method also comprises mapping the given portion of the time-frequency representation, which is described by the encoded audio information, to a time domain representation using the selected window.

Another embodiment according to the invention creates a method for providing an encoded audio information on the basis of an input audio information. The method comprises providing a sequence of audio signal parameters (for example, a time-frequency-domain representation) on the basis of a plurality of windowed portions of the input audio information. For providing the sequence of audio signal parameters, a switching is performed between a usage of windows having a longer transition slope and windows having a shorter transition slope, and also between a usage of windows having two or more different transform lengths, to adapt window shapes for obtaining the windowed portions of the input audio information in dependence on the characteristics of the input audio information. The method also comprises encoding a window information, describing a type of window used for transforming a current portion of the input audio information, using a variable-length codeword.

In addition, embodiments according to the invention create computer programs for implementing said methods.

BRIEF DESCRIPTION OF THE DRAWINGS

Embodiments of the present invention will be detailed subsequently referring to the appended drawings, in which:

FIG. 4 shows a graphic representation of allowable transitions between windows of different window types, which can be applied in the design of embodiments according to the invention;

FIG. 6*a* shows a table representing a proposed bitstream syntax, according to an embodiment of the invention;

FIG. 6*b* shows a graphical representation of a mapping from a window type of the current frame to a "window_length" information and a "transform_length" information;

FIG. 6*c* shows a graphic representation of a mapping to obtain the window type of the current frame on the basis of a previous core mode information, a "window_length" information of the previous frame, a "window_length" information of the current frame and a "transform_length" information of the current frame;

FIG. 7*a* shows a table representing a syntax of a "window_length" information;

FIG. 7*b* shows a table representing a syntax of a "transform_length" information;

FIG. 7*c* shows a table representing a new bitstream syntax and transitions;

FIG. 8 shows a table giving an overview over all combinations of the "window_length" information and the "transform_length" information;

FIG. 9 shows a table representing a bit saving, which can be obtained using an embodiment of the invention;

FIG. 10*a* shows a syntax representation of a so-called USAC raw data block;

FIG. 10*b* shows a syntax representation of a so-called single-channel-element;

FIG. 10*c* shows a syntax representation of a so-called channel-pair-element;

FIG. 10*d* shows a syntax representation of a so-called ICS information;

FIG. 10*e* shows a syntax representation of a so-called frequency-domain channel stream;

DETAILED DESCRIPTION OF THE INVENTION

Audio Encoder Overview

In the following, an audio encoder will be described in which the inventive concept can be applied. However, it should be noted that the audio encoder described with reference to FIG. 1 should be considered as an example only of an audio encoder in which the invention can be applied. However, even though a comparatively simple audio encoder is discussed with reference to FIG. 1, it should be noted that the invention can also be applied in much more elaborate audio encoders, for example audio encoders which are capable of switching between different encoding core modes (for example, between frequency-domain encoding and linear-prediction-domain encoding). Nevertheless, for the sake of simplicity, it appears to be helpful to understand the basic ideas of a simple frequency domain audio encoder.

Figure 1A:
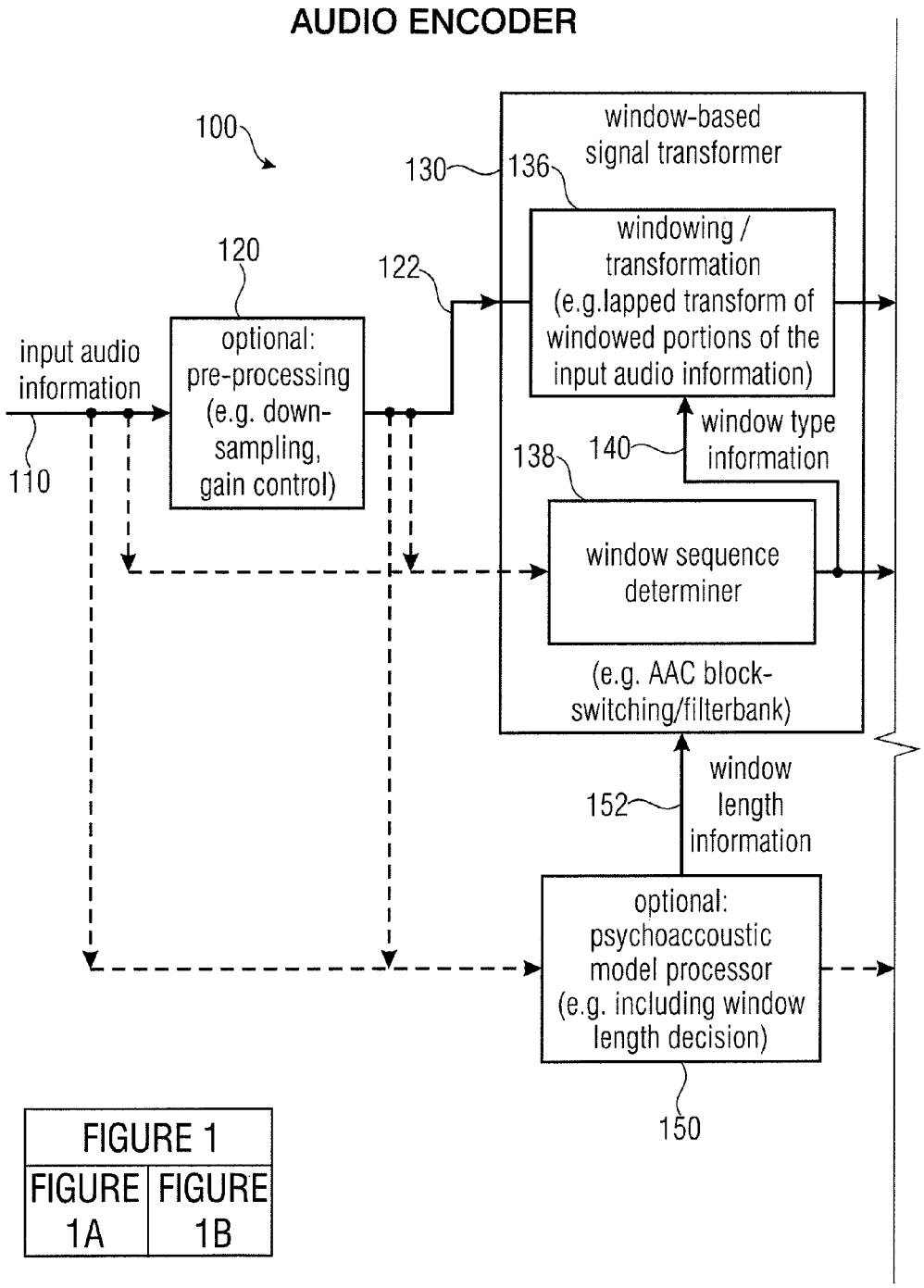
FIG. 1 shows a block schematic diagram of an audio encoder, according to an embodiment of the invention.
Figure 1B:
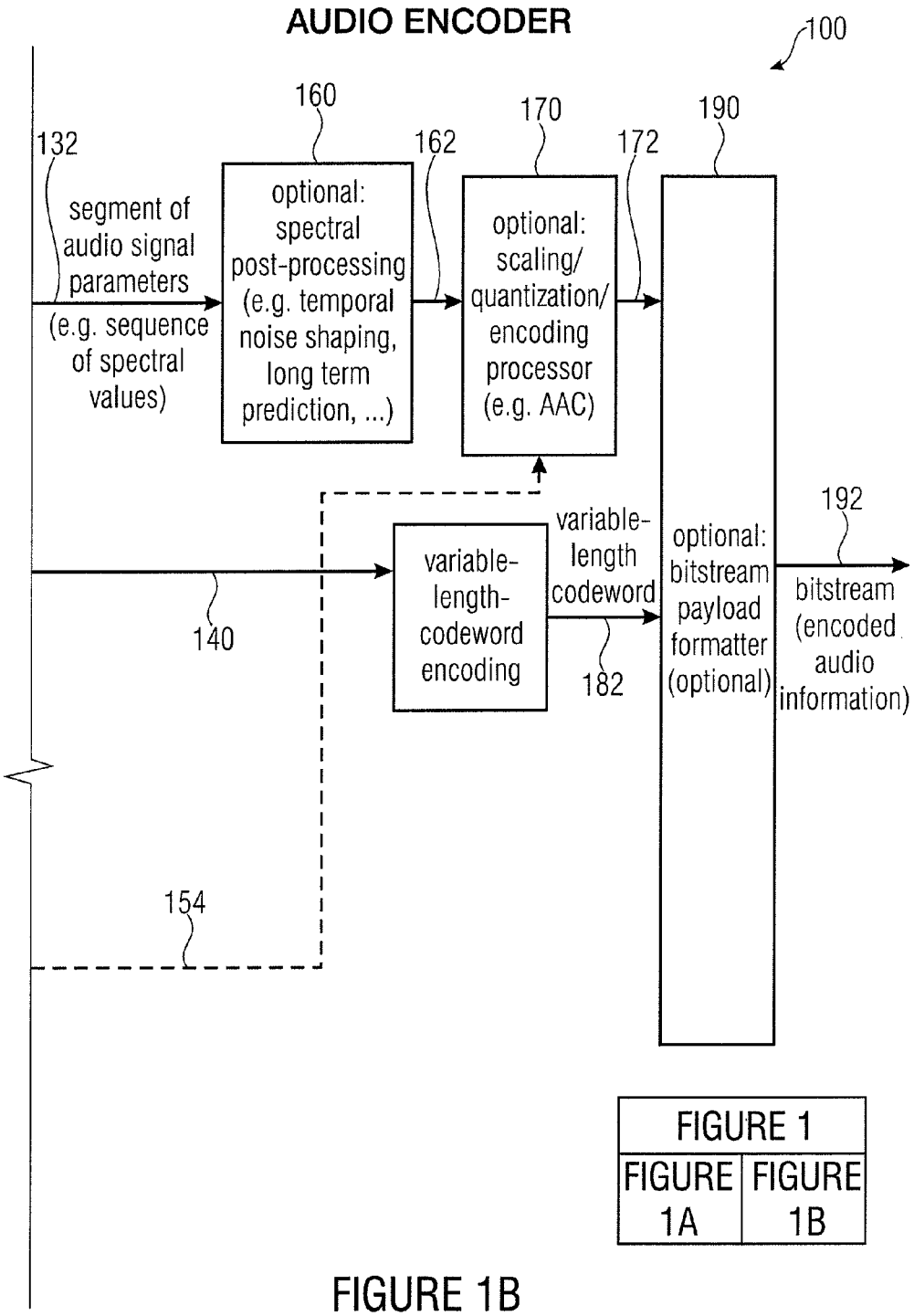

The audio encoder shown in FIG. 1 is very similar to the audio encoder described in the international standard ISO/IEC 14496-3:2005 (E), part 3, subpart 4 and also in the documents referenced therein. Accordingly, reference should be made to said standard, the documents cited therein and the extensive literature related to MPEG audio encoding.

The audio encoder 100 shown in FIG. 1 is configured to receive an input audio information 110, for example a time-domain audio signal. The audio encoder 100 further comprises an optional preprocessor 120 configured to optionally preprocess the input audio information 110, for example by down-sampling the input audio information 110 or by controlling a gain of the input audio information 110. The audio encoder 100 also comprises, as a key component, a window-based signal transformer 130, which is configured to receive the input audio information 110, or a preprocessed version 122 thereof; and to transform the input audio information 110 or the preprocessed version 122 thereof into the frequency domain (or time-frequency-domain), in order to obtain a sequence of audio signal parameters, which may be spectral values in a time-frequency domain. For this purpose, the window-based signal transformer 130 comprises a windower/transformer 136, which may be configured to transform blocks of samples (e.g. "frames") of the input audio information 110, 122 into sets of spectral values 132. For example, the windower/transformer 136 may be configured to provide one set of spectral values for each block of samples (i.e. for each "frame") of the input audio information. However, the blocks of samples (i.e. "frames") of the input audio information 110, 122 may advantageously be overlapping, such that temporally adjacent blocks of samples (frames) of the input audio information 110, 122 share a plurality of samples. For example, two temporally subsequent blocks of samples (frames) may overlap by approximately 50% of the samples. Accordingly, the windower/transformer 136 may be configured to perform a so-called lapped transform, for example a modified-discrete-cosine-transform (MDCT). However, when performing the modified-discrete cosine transform, the windower/transformer 136 may apply a window to each block of samples, thereby weighting central samples (temporally arranged in the proximity of a temporal center of a block of samples) stronger than peripheral samples (temporally arranged in the temporal proximity of the leading and trailing end of a block of samples). The windowing may help to avoid artifacts, which would originate from the segmentation of the input audio information 110, 122 into blocks. Thus, the application of windows before or during the transform from the time-domain to the time-frequency-domain allows for a smooth transition between subsequent blocks of samples of the input audio information 110, 122. For details regarding the windowing, reference is again made to the international standard ISO/IEC 14496, part 3, subpart 4 and the documents referenced therein. In a very simple version of the audio encoder, a number of 2N samples of an audio frame (defined as a block of samples) will be transformed into a set of N spectral coefficients independent from the signal characteristics. However, it has been found that such concept, in which a uniform transform length of 2N samples of the audio information 110, 122 is used independent of the characteristics of the input audio information 110, 122 results in a severe degradation of transitions, because in the case of a transition, the energy of the transition is spread out over the entire frame when decoding the audio information. Nevertheless, it has been found that an improvement in the encoding of edges can be obtained if a shorter transform length (e.g. 2N/8=N/4 samples per transform) is chosen. However, it has also been found that the choice of a shorter transform length typically increases the bitrate that may be used, even if less spectral values are obtained for a shorter transform length when compared to a longer transform length. Accordingly, it has been found to be recommendable to switch from a long transform length (e.g. 2N samples per transform) to a short transform length (e.g. 2N/8=N/4 samples per transform) in the proximity of a transition (also designated as edge) of the audio content, and to switch back to the long transform length (e.g. 2N-samples per transform) after the transition. The switching of the transform length is related to a change of a window applied for windowing the samples of the input audio information 110, 122 before or during the transform.

Regarding this issue, it should be noted that in many cases an audio encoder is capable of using more than two different windows. For example, a so-called "only_long_sequence" may be used for encoding a current audio frame, if both the preceding frame (preceding the currently considered frame) and the following frame (following the currently considered frame) are encoded using a long transform length (e.g. 2N samples). In contrast, a so-called "long_start_sequence" may be used in a frame, which is transformed using a long transform length, which is preceded by a frame transformed using a long transform length and which is followed by a frame transformed using a short transform length. In a frame, which is transformed using a short transform length, a so-called "eight_short_sequence" windows sequence, which comprises eight short and overlapping (sub-)windows, may be applied. In addition, a so-called "long_stop_sequence" window may be applied for transforming a frame, which is preceded by a previous frame transformed using a short transform length and which is followed by a frame transformed using a long transform length. For details regarding the possible windows sequences, reference is made to ISO/IEC 14496-3:2005 (E) part 3, subpart 4. Also, reference is made to FIGS. 3, 4, 5, 6, which will be explained in detail below.

However, it should be noted in some embodiments, one or more additional types of windows may be used. For example, a so-called "stop_start_sequence" window may be applied if the current frame is preceded by a frame, in which a short transform length is used, and if the current frame is followed by a frame in which a short-transform-length is used.

Accordingly, the window-based signal transformer 130 comprises a window sequence determiner 138, which is configured to provide a window type information 140 to the windower/transformer 136, such that the windower/transformer 136 can use an appropriate type of window ("window sequence"). For example, the window sequence determiner 130 may be configured to directly evaluate the input audio information 110 or the preprocessed input audio information 122. However, alternatively, the audio encoder 100 may comprise a psycho-acoustic model processor 150, which is configured to receive the input audio information 110 or the preprocessed input audio information 122, and to apply a psycho-acoustic model in order to extract information, which is relevant for the encoding of the input audio information 110, 122, from the input audio information 110, 122. For example, the psycho-acoustic model processor 150 may be configured to identify transitions within the input audio information 110, 122 and to provide a window length information 152, which may signal frames in which a short transform length is desired because of the presence of a transition in the corresponding input audio information 110, 122.

The psycho-acoustic model processor 150 may also be configured to determine, which spectral values need to be encoded with high resolution (i.e. fine quantization) and which spectral values may be encoded with lower resolution (i.e. coarser quantization) without obtaining a severe degradation of the audio content. For this purpose, the psycho-acoustic model processor 150 can be configured to evaluate psycho-acoustic masking effects, thereby identifying spectral values (or bands of spectral values) which are of lower psycho-acoustic relevance and other spectral values (or bands of spectral values) which are of higher psycho-acoustic relevance. Accordingly, the psycho-acoustic model processor 150 provides a psycho-acoustic relevance information 154.

The audio encoder 100 further comprises an optional spectral processor 160, which is configured to receive the sequence of audio signal parameters 132 (for example, a time-frequency-domain representation of the input audio information 110, 122) and to provide, on the basis thereof, a post-processed sequence of audio signal parameters 162. For example, the spectral post-processor 160 may be configured to perform a temporal noise shaping, a long-term prediction, a perceptual noise substitution and/or an audio-channel processing.

The audio encoder 100 also comprises an optional scaling/quantization/encoding processor 170, which is configured to scale the audio signal parameters (e.g. time-frequency-domain values or "spectral values") 132, 162, to perform a quantization and to encode the scaled and quantized values. For this purpose, the scaling/quantization/encoding processor 170 may be configured to use the information 154 provided by the psycho-acoustic model processor, for example in order to decide which scaling and/or which quantization is to be applied to which of the audio signal parameters (or spectral values). Accordingly, the scaling and quantization can be adapted such that a desired bit rate of the scaled, quantized and encoded audio signal parameters (or spectral values) is obtained.

In addition, the audio encoder 100 comprises a variable-length-codeword encoder 180, which is configured to receive the window type information 140 from the window sequence determiner 138 and to provide, on the basis thereof, a variable-length-codeword 182, which describes the type of window used for the windowing/transformation operation performed by the windower/transformer 136. Details regarding the variable-length-codeword encoder 180 will subsequently be described.

Moreover, the audio encoder 100 optionally comprises a bitstream payload formatter 190, which is configured to receive the scaled, quantized and encoded spectral information 172 (which describes the sequence of audio signal parameters or spectral values 132) and the variable-length-codeword 182 describing the type of window used for the windowing/transform operation. Accordingly the bitstream payload formatter 190 provides a bitstream 192, in which the information 172 and the variable-length-codeword 182 are incorporated. The bitstream 192 serves as an encoded audio information, and may be stored on a medium and/or transferred from the audio encoder 100 to an audio decoder.

To summarize the above, the audio encoder 100 is configured to provide the encoded audio information 192 on the basis of the input audio information 110. The audio encoder 100 comprises, as an important component, the window-based signal transformer 130, which is configured to provide a sequence of audio signal parameters 132 (for example a sequence of spectral values) on the basis of a plurality of windowed portions of the input audio information 110. The window-based signal transformer 130 is configured so that a window type for obtaining the windowed portions of the input audio information is selected in dependence on characteristics of the audio information. The window-based signal transformer 130 is configured to switch between a usage of windows having a longer transition slope and windows having a shorter transition slope, and to also switch between a usage of windows having two or more different transformation lengths. For example, the window-based signal transformer 130 is configured to determine a window type used for transforming a current portion (e.g. frame) of the input audio information in dependence on a window type used for transforming a preceding portion (e.g. frame) of the input audio information, and in dependence on an audio content of the current portion of the input audio information. However, the audio encoder is configured to encode, for example using the variable-length-codeword encoder 180, the window type information 140 describing a type of window used for transforming a current portion (e.g. frame) of the input audio information using a variable-length-codeword.

Transform Window Types

In the following, a detailed description of the different windows, which can be applied by the windower/transformer 136, and which are selected by the window sequence determiner 138, will be described. However, the windows discussed herein should be taken as an example only. Subsequently, inventive concepts for the efficient encoding of the window type will be discussed.

Taking reference now to FIG. 3, which shows a graphical representation of different types of transform windows, an overview over new sample windows will be given. However, additional reference is made to ISO/IEC 14496-3, part 3, subpart 4, in which the concepts to apply transform windows is described in even more detail.

Figure 3B:
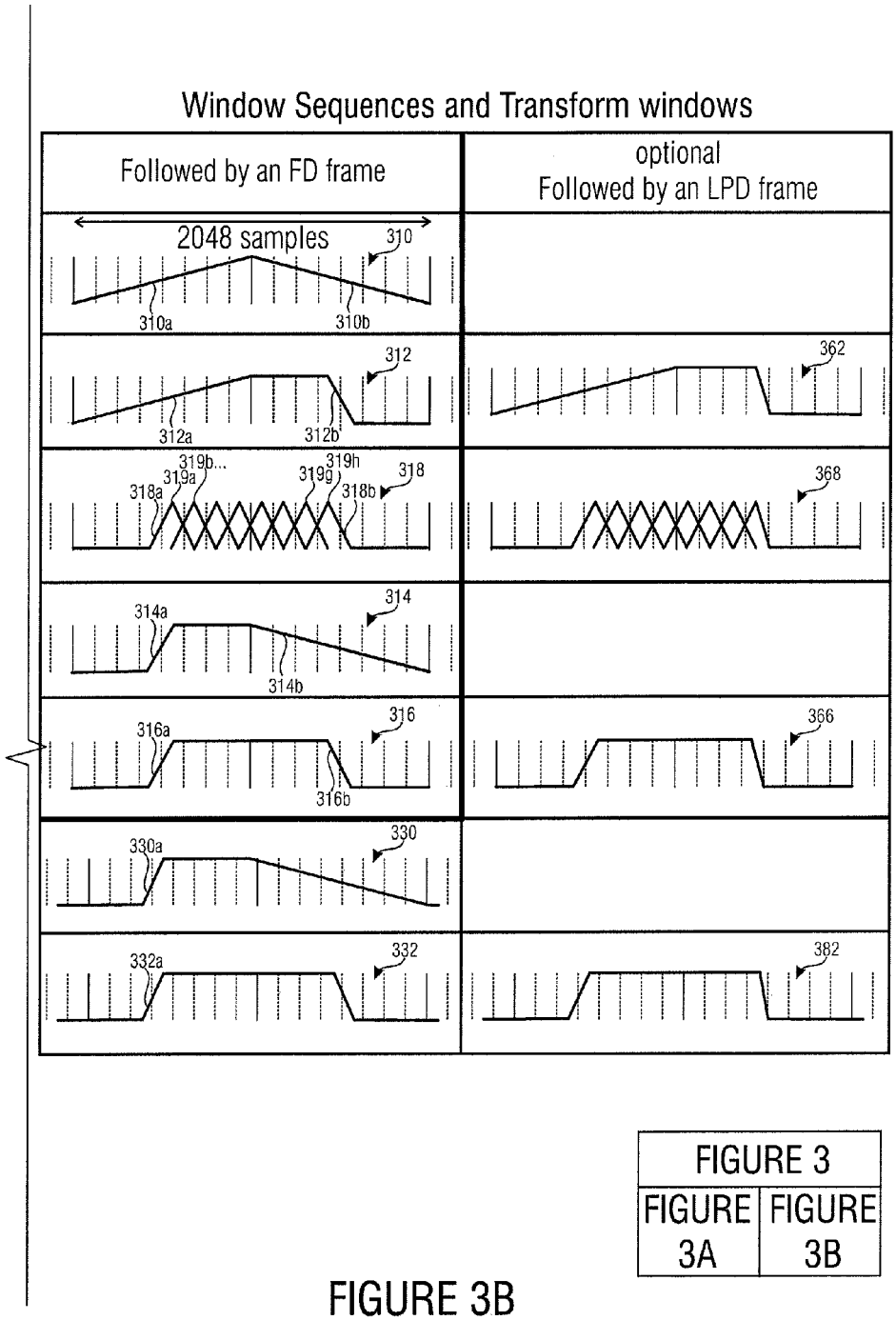
FIG. 3 shows a schematic representation of different window types, which can be used in accordance with the inventive concept.

FIG. 3 shows a graphical representation of a first window type 310, which comprises a (comparatively) long left-sided window slope 310*a* (1024 samples) and a long right-sided window slope 310*b* (1024 samples). A total of 2048 samples and 1024 spectral coefficients are associated to the first window type 310, such that the first window type 310 comprises a so-called "long transform length".

A second window type 312 is designated as "long_start_sequence" or "long_start_window". The second window type comprises a (comparatively) long left-sided window slope 312*a* (1024 samples) and a (comparatively) short right-sided window slope 312*b* (128 samples). A total of 2048 samples and 1024 spectral coefficients are associated to the second window type, such that the second window type 312 comprises a long transform length.

The third window type 314 is designated as "long_stop_sequence" or "long_stop_window". The third window type 314 comprises a short left-sided window slope 314*a* (128 samples) and a long right-sided window slope 314*b* (1024 samples). A total of 2048 samples and 1024 spectral coefficients are associated to the third window type 314, such that the third window type comprises a long transform length.

The fourth window type 316 is designated as a "stop_start_sequence" or "stop_start_window". The fourth window type 316 comprises a short left-sided window slope 316*a* (128 samples) and a short right-sided window slope 316*b* (128 samples). A total of 2048 samples and 1024 spectral coefficients are associated with the fourth window type, such that the fourth window type comprises a "long transform length".

A fifth window type 318 significantly differs from the first to fourth window types. The fifth window type comprises a superposition of eight "short windows" or sub-windows 319*a* to 319*h*, which are arranged to overlap temporally. Each of the short windows 319*a*-319*h* comprises a length of 256 samples. Accordingly, a "short" MDCT transform, transforming 256 samples into 128 spectral values, is associated to each of the short windows 319*a*-319*h*. Accordingly, eight sets of 128 spectral values each are associated with the fifth window type 318, while a single set of 1024 spectral values is associated with each of the first to fourth window types 310, 312, 314, 316. Accordingly, it can be said that the fifth window type comprises a "short" transform length. Nevertheless, the fifth window type comprises a short left-sided window slope 318*a* and a short right-sided window slope 318*b*.

Thus, for a frame to which the first window type 310, the second window type 312, the third window type 314 or the fourth window type 316 is associated, 2048 samples of the input audio information are jointly windowed and MDCT transformed, as a single group, into the time-frequency-domain. In contrast, for a frame to which the fifth window type 318 is associated, eight (at least partially overlapping) subsets of 256 samples each are individually (or separately) MDCT transformed, such that eight sets of MDCT coefficients (time-frequency values) are obtained.

Taking a reference again to FIG. 3, it should be noted that FIG. 3 shows a plurality of additional windows. These additional windows, namely a so-called "stop_1152_sequence" or "stop_window_1152" 330 and a so-called "stop_start_1152_sequence" or "stop_start_window_1152" 332 may be applied if the current frame is preceded by a previous frame, which is encoded in a linear-prediction-domain. In such cases, a length of the transform is adapted in order to allow for a cancellation of time-domain-aliasing artifacts.

Also, additional windows 362, 366, 368, 382 may optionally be applied if the current frame is followed by a subsequent frame, which is encoded in the linear-prediction-domain. However, window types 330, 332, 362, 366, 368, 382 should be considered as optional, and are not required for implementing the inventive concept.

Transitions Between Transform Window Types

Taking reference now to FIG. 4, which shows a schematic representation of allowed transitions between window sequences (or types of transform windows), some further details will be explained. Noting that two subsequent transform windows, each having one of the window types 310, 312, 314, 316, 318, are applied to partially overlapping blocks of audio samples, it can be understood that a right-sided window slope of a first window should be matched to a left-sided window slope of a second, subsequent window in order to avoid artifacts caused by the partial overlap. Accordingly, a choice of window types for the second frame (out of two subsequent frames) is limited, if the window type for the first frame (out of the two subsequent frames) is given. As can be see in FIG. 4, if the first window is an "only_long_sequence" window, the first window may only be followed by an "only_long_sequence" window or a "long_start_sequence" window. In contrast, it is not allowable to use an "eight_short_sequence" window, a "long_stop_sequence" window or a "stop_start_sequence" window for the second frame following the first frame, if the "only_long_sequence" window is used for transforming the first frame. Similarly, if a "long_stop_sequence" window is used in the first frame, the second frame may use a "only_long_sequence" window or a "long_start_sequence" window, but the second frame may not use a "eight_short_sequence" window, a "long_stop_sequence" window or a "stop_start_sequence" window.

In contrast, if the first frame (out of two subsequent frames) uses a "long_start_sequence" window, an "eight_short_sequence" window or a "stop_start_sequence" window, the second frame (out of the two subsequent frames) may not use an "only_long_sequence" window or a "long_start_sequence" window, but may use an "eight_short_sequence" window, a "long_stop_sequence" window or a "stop_start_sequence" window.

Allowable transitions between the window types "only_long_sequence", "long_start_sequence", "eight_short_sequence", "long_stop_sequence" and "stop_start_sequence" are shown by a "check" in FIG. 4. In contrast, transitions between window types, for which there is not "check", are not allowable in some embodiments.

Furthermore, it should be noted that additional window types "LPD_sequence", "stop_1152_sequence" and "stop_start_1152_sequence" may be usable, if transitions between a frequency-domain core mode and a linear-prediction-domain core mode are possible. Nevertheless, such a possibility should be considered optional and will be discussed later on.

Example Window Sequence

Figure 5:
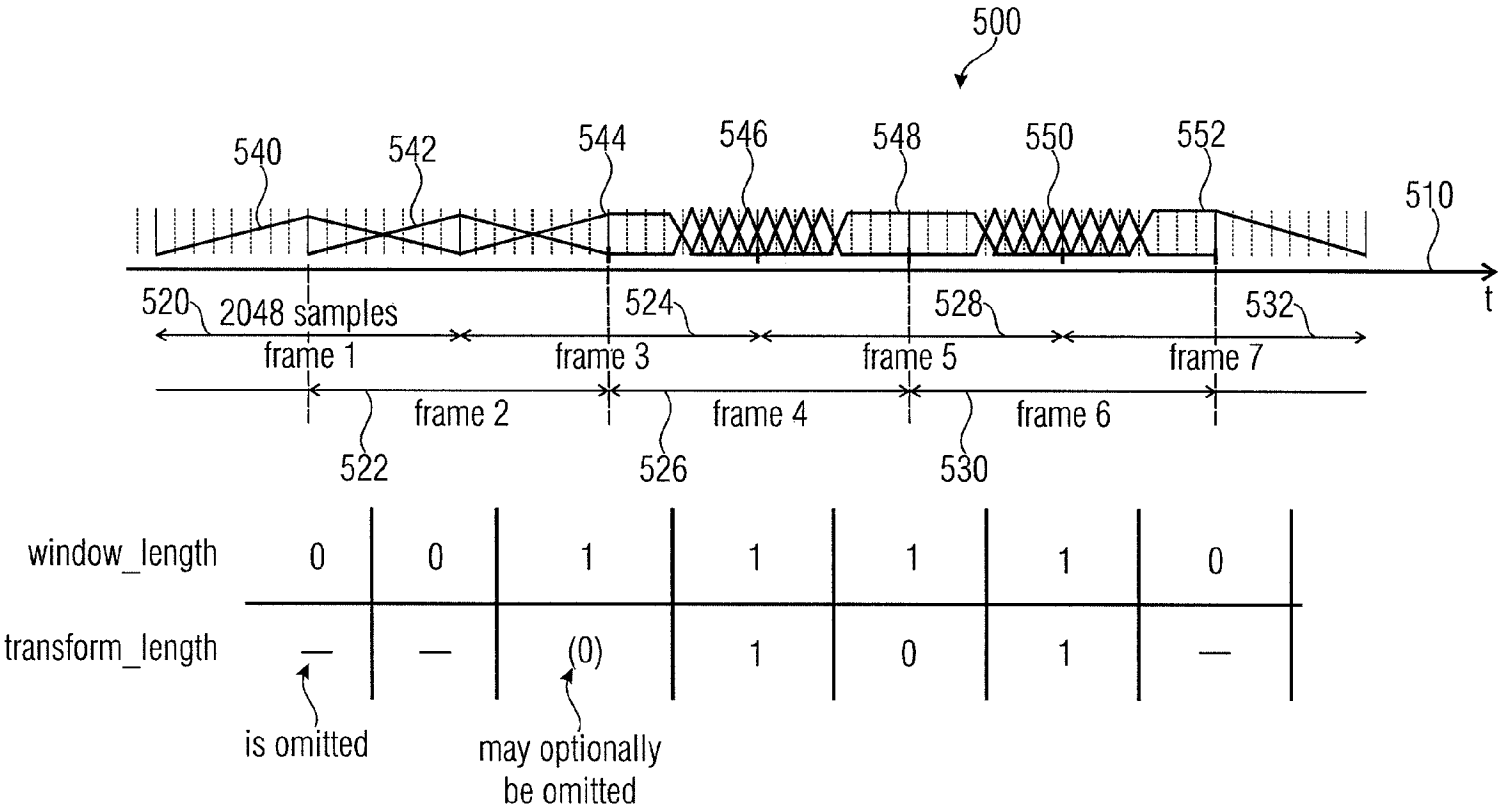
FIG. 5 shows a graphic representation of a sequence of different window types, which may be generated by an inventive encoder or which may be processed by an inventive audio decoder.

In the following, a window sequence will be described, which makes use of the window types 310, 312, 314, 316, 318. FIG. 5 shows a graphical representation of such a window sequence. As can be seen, an abscissa 510 indicates the time. Frames which overlap by approximately 50% are marked in FIG. 5 and designated with "frame 1" to "frame7". FIG. 5 shows a first frame 520, which may, for example, comprise 2048 samples. A second frame 522 is temporally shifted with respect to the first frame 520 by (approximately) 1024 samples, such that the second frame overlaps the first frame 520 by (approximately) 50%.

A temporal alignment of a third frame 524, a fourth frame 526, a fifth frame 528, a sixth frame 530 and a seventh frame 532 can be seen in FIG. 5. An "only_long_sequence" window 540 (of type 310) is associated to the first frame 520. Also, an "only_long_sequence" window 542 (of type 310) is associated to the second frame 522. A "long_start_sequence" window 544 (of type 312) is associated to the third frame, an "eight_short_sequence" window 546 (of type 318) is associated to the fourth frame 526, a "stop_start_sequence" window 548 (of type 316) is associated to the fifth frame, an "eight_short_sequence" window 550 (of type 318) is associated to the sixth frame 530 and a "long_stop_sequence" window 552 (of type 314) is associated with the seventh frame 532. Accordingly, a single set of 1024 MDCT coefficients is associated with the first frame 520, anther single set of 1024 MDCT coefficients is associated with the second frame 522 and yet another single set of 1024 MDCT coefficients is associated with the third frame 524. However, eight sets of 128 MDCT coefficients are associated with the fourth frame 526. A single set of 1024 MDCT coefficients is associated with the fifth frame 528.

The window sequence shown in FIG. 5 may for example bring along a particularly bitrate-efficient encoding result, if there is a transient event at a central portion of the fourth frame 526, and if there is another transient event at a central portion of the sixth frame 530, while the signal is approximately stationary during the rest of the time (e.g. during the first frame 520, the second frame 522, the beginning of the third frame 524, the center of the fifth frame 528 and the end of the seventh frame 532).

However, as shall be explained in detail in the following, the present invention creates a particularly efficient concept for encoding the types of windows associated with the audio frames. Regarding this issue, it should be noted that a total of five different types of windows 310, 312, 314, 316, 318 are used in the window sequence 500 of FIG. 5. Accordingly, "normally" three bits would be used for encoding the type of frame. In contrast, the present invention creates a concept which allows for an encoding of the window type with reduced bit demand.

Taking reference now to FIG. 6*a*, and also to FIGS. 7*a*, 7*b* and 7*c*, the inventive concept for encoding the window type will be explained. FIG. 6*a* shows a table representing a proposed syntax of a window type information, which includes a rule for encoding the window type. For the purpose of explanation, it is assumed that the window type information 140, which is provided to the variable-length-codeword encoder 180 by the window sequence determiner 138, describes the window type of the current frame and may take one of the values "only_long_sequence", "long_start_sequence", "eight_short_sequence", "long_stop_sequence", "stop_start_sequence" and optionally even one of the values "stop_1152_sequence" and "stop_start_1152_sequence". However, according to the inventive encoding concept, the variable-length-codeword encoder 180 provides a 1-bit "window_length" information", which describes a length of a right window slope of the window associated with the current frame. As can be seen in FIG. 7*a*, a value of "0" of the 1-bit "window_length" information may represent a length of the right window slope of 1024 samples and a value "1" may represent a length of the right window slope of 128 samples. Accordingly, the variable-length-codeword encoder 180 may provide a value of "0" of the "window_length" information if the window type is "only_long_sequence" (first window type 310) or "long_stop_sequence" (third window type 314). Optionally, the variable-length-codeword encoder 180 may also provide a "window_length" information of "0" for a window of type "stop_1152_sequence" (window type 330). In contrast, the variable-length-codeword encoder 180 may provide a value of "1" of the "window_length" information for a "long_start_sequence" (second window type 312), for a "stop_start_sequence" (fourth window type 316) and for an "eight_short_sequence" (fifth window type 318). Optionally, the variable-length-codeword encoder 180 may also provide a "window_length" information of "1" for a "stop_start_1152_sequence" (window type 332). In addition, the variable-length-codeword encoder 180 may optionally provide a value of "1" of the "window_length" information for one or more of the window types 362, 366, 368, 382.

However, the variable-length-codeword encoder 180 is configured to selectively provide another 1-bit information, namely the so-called "transform_length" information of the current frame, in dependence on the value of the 1-bit "window_length" information of the current frame. If the "window_length" information of the current frame takes the value "0" (i.e. for the window types "only_long_sequence", "long_stop_sequence" and optionally "stop_1152_sequence"), the variable-length-codeword encoder 180 does not provide a "transform_length" information for inclusion into the bitstream 192. In contrast, if the "window_length" information of a current frame takes the value "1" (i.e. for the window types "long_start_sequence", "stop_start_sequence", "eight_short_sequence" and, optionally, "LPD_start_sequence" and "stop_start_1152_sequence") the variable-length-codeword encoder 180 provides the 1-bit "transform_length" information for inclusion into the bitstream 192. The "transform_length" information is provided, if it is provided, such that the "transform_length" information represents the transform length applied to the current frame. Thus, the "transform_length" information is provided to take a first value (e.g. the value of "0) for the window types "long_start_sequence", "stop_start_sequence" and, optionally, "stop_start_1152_sequence" and "LPD_start_sequence", thereby indicating that the MDCT kernel size applied to the current frame is 1024 samples (or 1152 samples). In contrast, the "transform_length" information is provided by the variable-length-codeword encoder 180 to take a second value (e.g. a value of "1") if an "eight_short_sequence" window type is associated with the current frame, thereby indicating that the MDCT kernel size associated with the current frame is 128 samples (see the syntax representation of FIG. 7*b*).

To summarize, the variable-length-codeword encoder 180 provides a 1-bit codeword, comprising only the 1-bit "window_length" information of the current frame, for inclusion into the bitstream 192 if the right-sided window slope of the window associated to the current frame is comparatively long (long window slope 310*b*, 314*b*, 330*b*), i.e. for the window types "only_long_sequence", "long_stop_sequence" and "stop_1152_sequence".

In contrast, the variable-length-codeword encoder 180 provides a 2-bit codeword, comprising the 1-bit "window_length" information and the 1-bit "transform_length" information, for inclusion into the bitstream 192, if the right-sided window slope of the window associated with the current frame is a short window slope 312*b*, 316*b*, 318*b*, 332*b*, i.e. for window types "long_start_sequence", "eight_short_sequence", "stop_start_sequence" and, optionally, "stop_start_1152_sequence". Thus, 1 bit is saved for the case of the "only_long_sequence" window type and the "long_stop_sequence" window type (and optionally for a "stop_1152_sequence" window type).

Thus, only one or two bits, dependent on the window type associated with the current frame, may be used for encoding a selection out of five (or even more) possible window types.

It should be noted here, that FIG. 6*a* shows a mapping of a window type, which is defined in a window type column 630, onto a value of the "window_length" information, which is shown in a column 620, and also onto a provision status and value (if need be) of the "transform_length" information, which is shown in a column 624.

FIG. 6*b* shows a graphical representation of a mapping for deriving the "window_length" information of the current frame and the "transform_length" information (or an indication that the "transform_length" information is omitted from the bitstream 192) from the window type of the current frame. This mapping may be performed by the variable-length-codeword encoder 180, which receives the window type information 140 describing the window type of the current frame and maps it onto the "window_length" information as shown in a column 660 of the table of FIG. 6*b* and onto a "transform_length" information as shown in a column 662 of the table of FIG. 6*b*. In particular the variable-length-codeword encoder 180 may provide the "transform_length" information only if the "window_length" information takes a predetermined value (e.g. of "1") and otherwise omit the provision of the "transform_length" information, or suppress the inclusion of the "transform_length" information into the bitstream 192. Accordingly, a number of window-type bits included into the bitstream 192 for a given frame may vary, as indicated in a column 664 of a table of FIG. 6*b*, in dependence on the window type of the current frame.

It should also be noted that in some embodiments the window type of the current frame may be adapted or modified, if the current frame is followed by a frame encoded in the linear-prediction-domain. However, this typically does not affect the mapping of the window type onto the "window_length" information and the selectively provided "transform_length" information.

Accordingly, the audio encoder 100 is configured to provide a bitstream 192, such that the bitstream 192 obeys the syntax, which will be discussed below taking reference to FIGS. 10*a*-10*e*.

Audio Decoder Overview

Figure 2A:
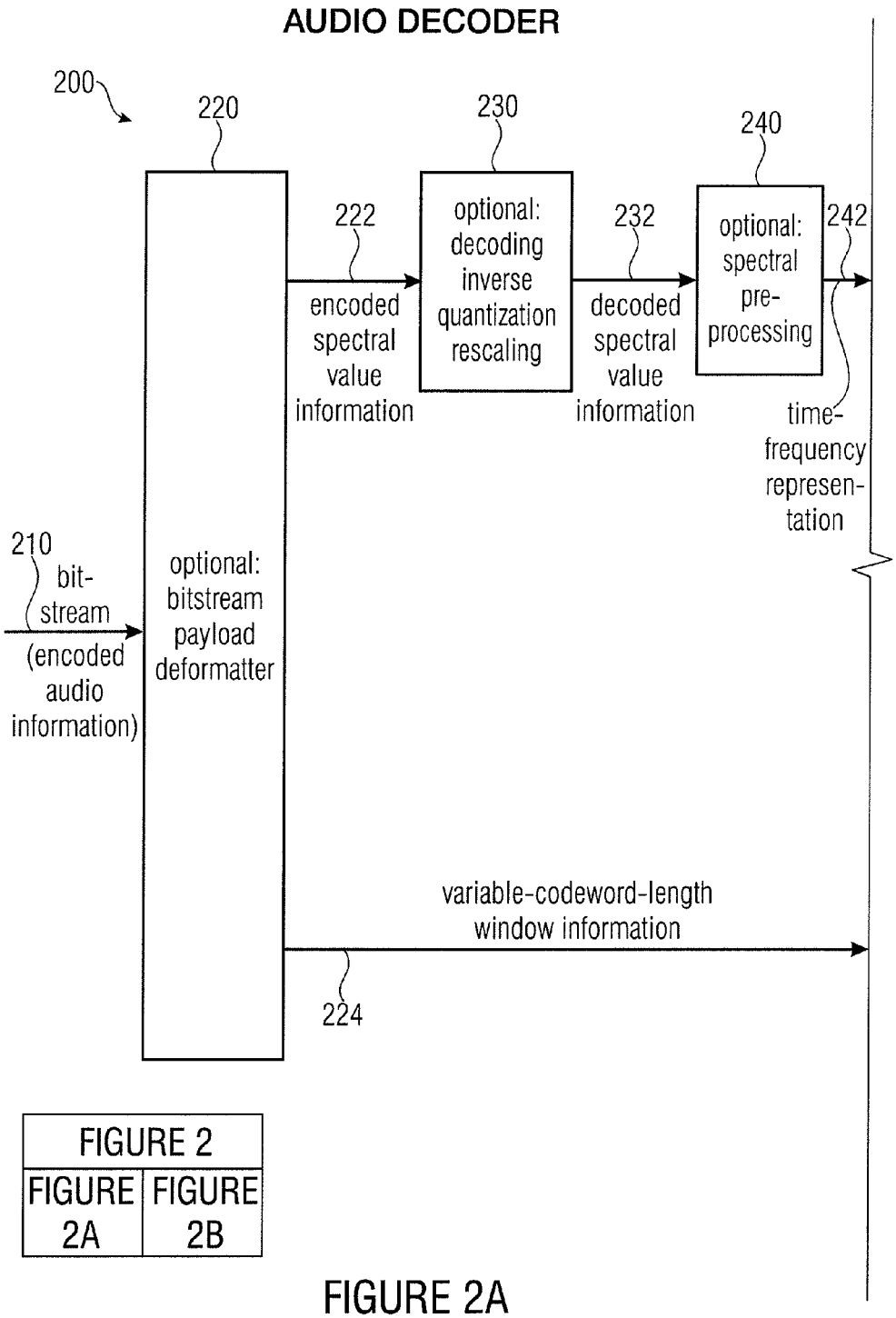
FIG. 2 shows a block schematic diagram of an audio decoder, according to an embodiment of the invention.
Figure 2B:
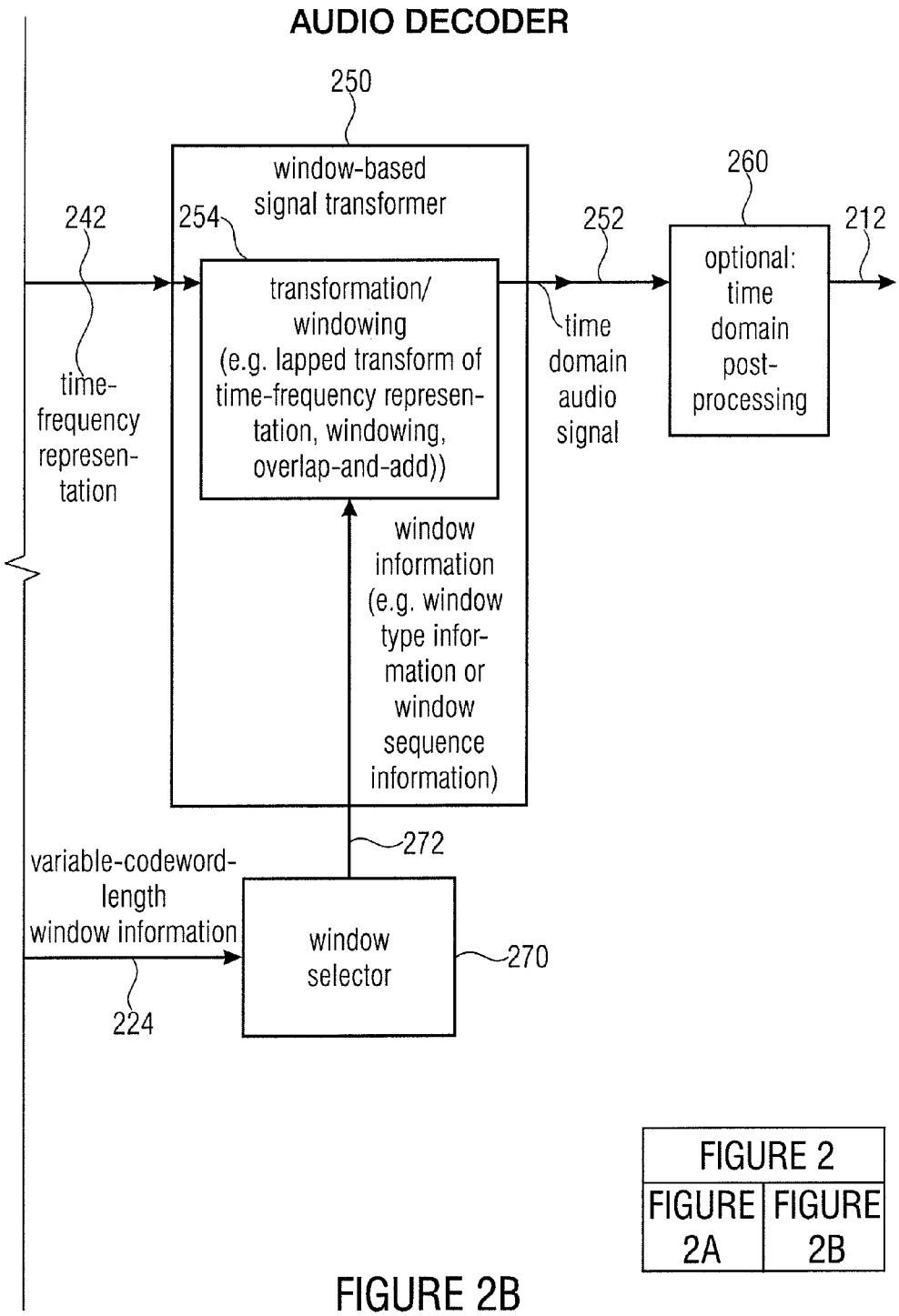

In the following, an audio decoder according to an embodiment of the invention will be described in detail taking reference to FIG. 2. FIG. 2 shows a schematic diagram of an audio decoder, according to an embodiment of the invention. The audio decoder 200 of FIG. 2 is configured to receive a bitstream 210 comprising an encoded audio information and to provide, on the basis thereof, a decoded audio information 212 (for example in the form of a time domain audio signal). The audio decoder 200 comprises an optional bitstream payload deformatter 220, which is configured to receive the bitstream 210 and to extract from the bitstream 210 an encoded spectral value information 222 and a variable-codeword-length window information 224. The bitstream payload deformatter 220 may be configured to extract additional information, like control information, gain information and additional audio parameter information, from the bitstream 210. However, this additional information is well known to a man skilled in the art and not relevant to the present invention. For further details, reference is made, for example, to the International Standard ISO/IEC 14496-3: 2005(E), part 3, subpart 4.

The audio decoder 200 comprises an optional decoder/inverse quantizer/rescaler 230 which is configured to decode the encoded spectral value information 222, to perform an inverse quantization and to also perform a resealing of the inversely quantized spectral value information, thereby obtaining a decoded spectral value information 232. The audio decoder 200 further comprises an optional spectral preprocessor 240, which may be configured to perform one or more spectral preprocessing steps. Some of the possible spectral preprocessing steps are, for example, explained in the International Standard ISO/IEC 14496-3: 2005(E), part 3, subpart 4. Accordingly, the functionality of the decoder/inverse quantizer/rescaler and the optional spectral preprocessor 240 results in the provision of a (decoded and optionally preprocessed) time-frequency representation 242 of the encoded audio information represented by the bitstream 210. The audio decoder 200 comprises, as a key component, a window-based signal transformer 250. The window-based signal transformer 250 is configured to transform the (decoded) time-frequency representation 242 into a time-domain audio signal 252. For this purpose, the window-based signal transformer 250 may be configured to perform a time-frequency-domain-to-time-domain transformation. For example, the transformer/windower 254 of the window-based signal transformer 250 may be configured to receive, as the time-frequency representation 242, modified-discrete-cosine-transform coefficients (MDCT coefficients) associated with temporally overlapping frame of the encoded audio information. Accordingly, the transformer/windower 254 may be configured to perform a lapped transform, in the form of a inverse-modified-discrete-cosine-transform (IMDCT), to obtain windowed time-domain portions (frames) of the encoded audio information, and to overlap-and-add subsequent windowed time-domain portions (frames) using a overlap-and-add operation. When reconstructing the time-domain audio signal 252 on the basis of the time-frequency representation 242, i.e. when performing the inverse-modified-discrete-cosine-transform in combination with the windowing and the overlap-and-add operation, the transformer/windower 254 may select a window, out of a plurality of available window types, in order to allow for an appropriate reconstruction and also in order to avoid any blocking artifacts.

The audio decoder also comprises an optional time domain postprocessor 260, which is configured to obtain the decoded audio information 212 on the basis of the time domain audio signal 252. However, it should be noted that the decoded audio information 212 may be identical to the time domain audio signal 252 in some embodiments. In addition, the audio decoder 200 comprises a window selector 270, which is configured to receive the variable-codeword-length window information 224, for example, from the optional bitstream payload deformatter 220. The window selector 270 is configured to provide a window information 272 (for example a window type information or a window sequence information) to the transformer/windower 254. It should be noted that the window selector 270 may or may not be part of the window-based signal transformer 250 depending on the actual implementation.

To summarize the above, the audio decoder 200 is configured for providing the decoded audio information 212 on the basis of the encoded audio information 210. The audio decoder 200 comprises, as a key component, the window-based signal transformer 250, which is configured to map a time-frequency representation 242, which is described by the encoded audio information 210, to a time-domain representation 252. The window-based signal transformer 250 is configured to select a window, out of a plurality of windows comprising windows of different transition slopes (for example different transition slope lengths) and windows of different transform lengths, on the basis of the window information 272. The audio decoder 200 comprises, as another key component, the window selector 270, which is configured to evaluate the variable-codeword-length window information 224 in order to select a window for a processing of a given portion of the time-frequency representation 242 associated with a given frame of the audio information. The other components of the audio decoder, namely the bitstream payload deformatter 220, the decoder/inverse quantizer/rescaler 230, the spectral preprocessor 240 and the time-domain-postprocessor 260 may be considered as being optional, but may be present in some implementations of the audio decoder 200.

In the following, details regarding the selection of the window for the transform/windowing performed by the transformer/windower 254 will be described. However, regarding the importance of the choice of different windows, reference is made to the above explanations.

The audio decoder 200 is advantageously capable of using the window types "only_long_sequence", "long_start_sequence", "eight_short_sequence", "long_stop_sequence" and "stop_start_sequence" described above. However, the audio decoder may optionally be capable of using additional window types, for example the so-called "stop_1152_sequence" and the so-called "stop_start_1152_sequence" (both of which may be used for a transition from a linear-prediction-domain encoded frame to frequency-domain encoded frame). In addition, the audio decoder 200 may be further configured to use additional window types, like for example, the window types 362, 366, 368, 382, which may all be adapted for a transition from a frequency-domain-encoded frame to a linear-prediction-domain-encoded frame. However, the usage of window types 330, 332, 362, 366, 368, 382 may be considered as being optional.

However, it is an important feature of the inventive audio decoder to provide a particularly efficient solution for deriving the appropriate window type from the variable-codeword-length window information 224. As discussed above, this will be further explained below taking reference to FIGS. 10*a*-10*e*.

The variable-codeword-length window information 224 typically comprises 1 or 2 bits per frame. Advantageously, the variable-codeword-length window information comprises a first bit carrying the "window_length" information of the current frame and a second bit carrying a "transform_length" information of the current frame, wherein the presence of the second bit ("transform_length" bit) is dependent on the value of the first bit ("window_length" bit). Thus, the window selector 270 is configured to selectively evaluate one or two window information bits ("window_length" and "transform_length") for deciding about the window type associated with the current frame in dependence on the value of the "window_length" bit associated with the current frame. Nevertheless, in the absence of the "transform_length" bit, the window selector 270 may naturally assume that the "transform_length" bit takes a default value.

In an advantageous embodiment, the window selector 270 may be configured to evaluate the syntax as described above with reference to FIG. 6*a*, and to provide the window information to 272 in accordance with said syntax.

Assuming first, that the audio decoder 200 operates in a frequency domain core mode, i.e. that there is no switching between the frequency domain core mode and the linear-prediction-domain core mode, it may be sufficient to distinguish the above mentioned five window types ("only_long_sequence", "long_start_sequence", "long_stop_sequence", "stop_start_sequence" and "eight_short_sequence"). In this case, the "window_length" information of the previous frame, the "window_length" information of the current frame and the "transform_length" information of the current frame (if available) may be sufficient to decide about the window type.

For example, assuming operation in the frequency-domain core mode only (at least over a sequence of three subsequent frames), it may be concluded from the fact that the "window_length" information of the previous frame indicates a long transition slope (value "0") and that the "window_length" information of the current frame indicates a long transition slope (value "0") that the window type "only_long_sequence" is associated to the current frame without evaluating the "transform_length" information, which is not transmitted by the encoder in this case.

Again assuming an operation in the frequency domain core mode only, it can be concluded from the fact that the "window_length" information of the previous frame indicates a long (right-sided) transition slope, and from the fact that the "window_length" information of the current frame indicates a short (right-sided) transition slope (value "1"), that the window type "long_start_sequence" is associated with the current frame, even without evaluating the "transform_length" information of a current frame (which may or may not be generated and/or transmitted by the encoder in this case).

Again assuming an operation in the frequency domain core mode only, it can be concluded from the fact that the "window_length" information of the previous frame indicates the presence of a short (right-sided) transition slope (value "1") and that the "window_length" information of the current frame indicates a long (right-sided) transition slope (value "0") that the window type "long_stop_sequence" is associated to the current frame, even without evaluating the "transform_length" information of the current frame (which is typically not provided by the corresponding audio encoder anyway).

If, however, the "window_length" information of the previous frame indicates the presence of a short (right-sided) transition slope and the "window_length" information of the current frame also indicates the presence of a short transition slope (value "1"), one might evaluate the "transform_length" information of the current frame. In this case, if the "transform_length" information of the current frame takes a first value (for example zero), the window type "stop_start_sequence" is associated with the current frame. Otherwise, i.e. if the "transform_length" information of the current frame takes a second value (for example one), it can be concluded that the window type "eight_short_sequence" is associated to the current frame.

To summarize the above, the window selector 270 is configured to evaluate the "window_length" information of the previous frame and the "window_length" information of the current frame in order to determine the window type associated with the current frame. In addition, the window selector 270 is configured selectively, in dependence on the value of the "window_length" information of the current frame (and possibly also in dependence on the "window_length" information of the previous frame, or a core mode information), take into consideration the "transform_length" information of the current frame to determine the window type associated with the current frame. Thus, the window selector 270 is configured to evaluate a variable-codeword-length window information in order to determine the window type associated with the current frame.

FIG. 6*c* shows a table representing a mapping of the "window_length" information of the previous frame, a "window_length" information of the current frame and a "transform_length" information of the current frame onto a window type of the current frame. The "window_length" information of the current frame and the "transform_length" information of the current frame may be represented by the variable-codeword-length window information 224. The window-type of the current frame may be represented by the window information 272. The mapping described by the table of FIG. 6*c* may be performed by the window selector 270.

As can be seen, the mapping may depend on the previous core mode. If the previous core mode is a "frequency-domain core mode" (abbreviated by "FD"), the mapping may take the form as discussed above. If, however, the previous core mode is a "linear-prediction-domain core mode" (abbreviated by "LPD"), the mapping may be altered, as can be seen in the last two rows of the table of FIG. 6*c*.

In addition, the mapping may be altered if the subsequent core mode (i.e. the core mode associated with the subsequent frame) is not a frequency-domain core mode; but a linear-prediction-domain core mode.

The audio decoder 200 may optionally comprise a bitstream parser configured to parse the bitstream 210 representing the encoded audio information and to extract from the bitstream a one-bit window-slope-length information (also designated herein as "window_length" information) and to selectively extract, in dependence on a value of the one-bit window slope length information, a one-bit transform-length information (designated herein as "transform_length" information). In this case, the window selector 270 is configured to selectively, in dependence on the window-slope-length information of the current frame, use or neglect the transform-length-information in order to select a window type for a processing of a given portion (e.g. frame) of the time-frequency representation 242. The bitstream parser may, for example, be part of the bitstream payload deformatter 220, and may enable the audio decoder 200 to properly handle the variable-codeword-length window information as discussed above and as also described with reference to FIGS. 10*a*-10*e*.

Switching Between Frequency-Domain Core Mode and Time-Domain Core Mode

In some embodiments, the audio encoder 100 and the audio decoder 200 may be configured to switch between a frequency domain core mode and a linear-prediction-domain core mode. As explained above, it is assumed that the frequency-domain core mode is the basic core mode, for which the above explanations hold. However, if the audio encoder is capable of switching between the frequency-domain core mode and the linear-prediction-domain core mode, there may still be a cross-fade (in the sense of an overlap-and-add operation) between frames encoded in the frequency-domain core mode and frames encoded in the linear-prediction-domain core mode. Accordingly, appropriate windows may be selected in order to ensure a proper cross-fade between frames being coded in different core modes. For example, in some embodiments, there may be two window types, namely window types 330 and 332 shown in FIG. 2B, which are adapted for a transition from a linear-prediction-domain core mode to a frequency-domain core mode. For example, the window type 330 may allow for a transition between a linear-prediction-domain-encoded frame and a frequency-domain-encoded frame having a long left-sided transition slope, for example, from the linear-prediction-domain-encoded frame to a frequency-domain-encoded frame using a window type "only_long_sequence" or a window type "long_start_sequence". Similarly, the window type 332 may allow for a transition from a linear-prediction-domain-encoded frame to a frequency-domain-encoded frame having a short left-sided transition slope (for example from a linear-prediction-domain-encoded frame to a frame having associated the window type "eight_short_sequence" or "long_stop_sequence" or "stop_start_sequence). Accordingly, the window selector 270 may be configured to select the window type 330, if it is found that the previous frame (preceding the current frame) is encoded in the linear-prediction domain, that the current frame is encoded in the frequency-domain and that the "window_length" information of the current frame indicates a long right-sided transition slope of the current frame (e.g. value "0"). In contrast, the window selector 270 is configured to select the window type 332 for the current frame, if it is found that the previous frame is encoded in the linear-prediction-domain, that the current frame is encoded in the frequency-domain and that the "window_length" information of the current frame indicates that a long right-sided transition slope is associated to the current frame (e.g. value "1").

Similarly, the window selector 270 may be configured to react to the fact that the subsequent frame (following the current frame) is encoded in the linear-prediction-domain, while the current frame is encoded in the frequency-domain. In this case, the window selector 270 may select one of the window types 362, 366, 368, 384, which are adapted to be followed by a linear-prediction-domain-encoded frame, instead of one of the window types 312, 316, 118, 332, which are adapted to be followed by a frequency-domain-encoded frame. However, except for the replacement of the window type 312 by the window type 362, the replacement of the window type 318 by the window type 368, the replacement of the window type 360 by the window type 366 and the replacement of the window type 332 by the window type 382, the selection of the window type may be unchanged when compared to a situation in which there are only frequency-domain-encoded frames.

Thus, the inventive mechanism of using a variable-codeword-length window information may be applied even in the case in which transitions between a frequency-domain-encoding and a linear prediction-encoding occur, without significantly compromising the coding efficiency.

Bitstream Syntax Details

In the following, details regarding the bitstream syntax of the bitstream 192, 210 will be discussed, taking reference to FIGS. 10*a*-10*e*. FIG. 10*a* shows a syntax representation of so-called unified-speech-and-audio-coding ("USAC") raw data block "USAC_raw_data_block". As can be seen, the USAC raw data block may comprise a so-called single-channel-element ("single_channel_element( )") and/or a channel pair element ("channel_pair_element( )"). However, the USAC raw data block may naturally comprise more than one single channel element and/or more than one channel-pair-element.

Taking reference now to FIG. 10*b*, which shows a syntax representation of a single channel element, some more details will be explained. As can be seen in FIG. 10*b*, a single channel element may comprise a core mode information, for example in the form of a "core mode" bit. The core mode information may indicate whether the current frame is encoded in a linear-prediction-domain core mode or in a frequency-domain core mode. In the case that the current frame is encoded in the linear-prediction-domain core mode, the single channel element may comprise a linear-prediction-domain channel stream ("LPD_channel_stream( )") In case the current frame is encoded in the frequency domain, the single channel element may comprise a frequency domain channel stream ("FD_channel_stream( )").

Taking reference now to FIG. 10*c*, which shows a syntax representation of a channel pair element, some additional details will be explained. A channel pair element may comprise a first core mode information, for example in the form of a "core_mode0" bit, describing a core mode of the first channel. In addition, the channel pair element may comprise a second core mode information in the form of a "core_mode1" bit, describing a core mode of the second channel. Thus, different or identical core modes may be selected for the two channels described by a channel pair element. Optionally, the channel pair element may comprise a common ICS information ("ICS_info( )") for both of the channel. This common ICS information is advantageous if the configuration of the two channels described by the channel pair element is very similar. Naturally, a common ICS information is advantageously only used if both channels are encoded in the same core mode.

In addition, the channel pair element comprises a linear prediction-domain channel stream ("LPD_channel_stream( )") or a frequency domain channel stream ("FD_channel_stream( )") associated with the first channel in dependence on the core mode defined for the first channel (by the core mode information "core_mode0").

Also, the channel pair element comprises a linear-prediction-domain channel stream ("LPD_channel_stream( )") or a frequency-domain channel stream ("FD_channel_stream( )") for the second channel in dependence on the core mode used for encoding the second channel (which may be signaled by the core mode information "core_mode1").

Taking reference now to FIG. 10*d*, which shows a syntax for a representation of the ICS information, some additional details will be described. It should be noted that the ICS information may be included in the channel pair element, or in the individual frequency-domain channel streams (as will be discussed with reference to FIG. 10*e*).

The ICS information comprises a one-bit (or single-bit) "window_length" information, which describes a length of a right-sided transition slope of the window associated with the current frame, for example in accordance with the definition given in FIG. 7*a*. If, and only if, the "window_length" information takes a predetermined value (e.g. "1"), the ICS information comprises an additional one-bit (or single-bit) "transform_length" information. The "transform_length" information describes a size of an MDCT kernel, for example, in accordance with the definition given in FIG. 7*b*. If the "window_length" information takes a different value than the predetermined value (for example the value "0"), the "transform_length" information is not included in (or omitted from) the ICS information (or in the corresponding bit stream). However, in this case, a bitstream parser of an audio decoder may set the recovered value of a decoder variable "transform_length" to a default value (for example "0").

In addition, the ICS information may comprise a so-called "window_shape" information, which may be a one-bit (or a single-bit) information describing a shape of a window transition. For example, the "window_shape" information may describe whether a window transition has a sine/cosine shape or a Kaiser-Bessel-derived shape. For details regarding the meaning of the "window_shape" information, reference is made, for example, to the international standard ISO/IEC 14496-3:2005 (E), part 3, subpart 4. However, it should be noted that the "window_shape" information leaves the basic window type unaffected and that the general characteristics (long transition slope or short transition slope; long transform length or short transform length) are left unaffected by the "window_shape" information.

Thus, in the embodiments according to the invention, the "window shape", i.e. the shape of the transitions, is determined separately from the window type, i.e. the general length of the transitions slopes (long or short) and the transform length (long or short).

In addition, the ICS information may comprise a window-type dependent scale factor information. For example, if the "window_length" information and the "transform_length" information indicate that the current window type is "eight_short_sequence", the ICS information may comprise a "max_sfb" information describing a maximum scale factor band and a "scale_factor_grouping" information describing a grouping of scale factor bands. Details regarding this information are described, for example, in the international standard ISO/IEC 14496-3:2005 (E), part 3, subpart 4. Alternatively, i.e. if the "window_length" information and the "transform_length" information indicate that the current frame is not of window-type "eight_short_sequence", the ICS information may comprise a "max_sfb" information only (but no "scale_factor_grouping" information).

In the following, some further details will be described taking reference to FIG. 10*e*, which shows a syntax representation of a frequency-domain channel stream ("FD_channel_stream( )"). The frequency-domain channel stream comprises a "global_gain" information describing a global gain associated with the spectral values. In addition, the frequency domain channel stream comprises a ICS information ("ICS_info( )"), unless such an information is already included in a channel pair element comprising the present frequency domain channel stream. Regarding the ICS information, details have been described with reference to FIG. 10*d*.

In addition, the frequency-domain channel stream comprises scale factor data ("scale_factor_data( )"), which describe a scaling to be applied to values (or scale factor bands) of the decoded spectral value information or a time-frequency representation. In addition, the frequency-domain channel stream comprises encoded spectral data, which may for example be arithmetically encoded spectral data (ac_spectral_data( )). However, a different encoding of the spectral data may be used. Regarding the scale factor data and the encoded spectral data, reference is again made to the international standard ISO/IEC 14496-3: 2005 (E), part 3, subpart 4. However, different encodings of the scale factor data and of the spectral data may naturally be applied, if desired.

Conclusions and Performance Evaluations

In the following, some conclusions are made, and a performance evaluation of the inventive concept will be given. The embodiments of the present invention create a concept for a reduction of the bitrate that may be used, which can be applied, for example, in combination with the audio coding schemes defined in the international standard ISO/IEC 14496-3:2005 (E), part 3, subpart 4. However, the concept discussed herein can also be used in combination with the so-called "unified speech and audio coding" approach (USAC). Based on the existing bitstream definitions and decoder architectures, the present invention creates a bitstream syntax modification, which simplifies the syntax of the signaling of window sequences, saves bitrate without increasing complexity and does not alter the decoder output waveform.

In the following, the background and idea underlying the present invention will be briefly discussed and summarized. In the current audio coding according to ISO/IEC 14496-3: 2005 (E) part 3, subpart4, and also in the USAC working draft, a codeword with a fixed length of two bits is sent to signal the window sequence. Additionally, the window sequence information of the previous frame is sometimes needed to determine the correct sequence.

However, it has been found that by taking this information into account and by making the codeword length variable (one or two bits), the bitrate can be reduced. A new codeword has a maximum length of two bits ("window_length" and in some cases "transform_length"). Thus, the bitrate is never increased (when compared to the conventional approach).

The new codeword ("window_length" and in some cases "transform_length") consists of one bit ("window_length") indicating the length of the right window slope and one bit ("transform_length") indicating the transform length. In many cases, the transform length can be derived unambiguously by information of the previous frame, namely window sequence and core mode. Thus, it is not necessary to retransmit this information. Accordingly, the bit "transform_length" is omitted in such cases, thereby leading to a reduction of the bitrate.

In the following, some details regarding the proposal for a new bitstream syntax according to the present invention will be discussed. The proposed new bitstream syntax allows for a more straightforward implementation and signaling of the window sequences, because it conveys only the information actually needed for determining the window sequence of the current frame, i.e. a right window slope and a transform length. The left window slope of the current frame is derived from the right window slope of the previous frame.

The proposal (or the proposed new bit stream) explicitly separates information on length of the window slope ("window_length" information) and on the transform length ("transform_length" information). The variable-length-codeword is a combination of both, where the first bit "window_length" determines the length of the right window slope (of the current frame) and the second bit "transform_length" determines the length of the MDCT (for the current frame) according to FIGS. 7*a* and 7*d*. In the case "window_length"==0, i.e. a long window slope is selected, the transmission of "transform_length" can be omitted (or is actually omitted), since an MDCT kernel size of 1024 samples (or 1152 samples in some cases) is mandatory.

FIG. 7*c* gives an overview over all combinations of "window_length" and "transform_length". As can be seen, there are only three meaningful combinations of the two one-bit information items "window_length" and transform_length", such that the transmission of the "transform_length" can be omitted if the "window_length" information takes the value zero without negatively affecting the transmission of the desired information.

In the following, the mapping of the "window_length" information and the "transform_length" information to a "window_sequence" information (which describes a type of window to be used for the current frame) will be briefly summarized. The table of FIG. 6*a* shows how the bitstream element "window_sequence" of the current status of the working drafts of the envisaged USAC standard can be derived from the new proposed bitstream elements. This demonstrates that the proposed change is "transparent" in terms of information content.

In other words, the inventive bitrate-reduced syntax for signaling the window type, which is based on the usage of a variable-codeword-length window information, is capable of carrying the "full" information content, which is conventionally transmitted using a higher bitrate. Also, the inventive concept can be applied in the conventional audio encoders and decoders, for example the audio encoder or audio decoder according to ISO/IEC 14496-3:2005 (E), part 3, subpart 4 or according to the current USAC working draft without any major modifications.

In the following, an evaluation of the achievable bit savings will be presented. However, it should be noted that in some cases the bit savings may be somewhat smaller than indicated, and that in other cases the bit savings may be even significantly larger than the discussed bit savings. The "bit saving evaluation" shown in FIG. 9 shows the bit saving evaluation for a lossless transcoding, comparing bitstreams using the new bitstream syntax to conventional bitstreams (which conventional bitstreams have been submitted for a call-for-proposals). As can be seen clearly, the transmission of the "transform_length" bit can be omitted, in accordance with the invention, in 95.67% of all frequency-domain frames for 12 kbps mono and up to 95.15% of all frequency-domain frames for 64 kbps.

As can be seen from FIG. 9, between 2 and 24 bits per second can be saved on average, without compromising the quality of the audio content. In view of the fact that bitrate is a very critical resource for storage and transmission of an audio content, this improvement can be considered to be very valuable. Also, it should be noted that in some cases the improvement in bitrate can be significantly larger, for example if frames are chosen to be comparatively short.

To summarize the above, the present invention proposes a new bitstream syntax for the signaling of window sequences. The new bitstream syntax saves data rate and is more logical and more flexible compared to the old syntax. It is easy to implement and has no drawbacks with respect to complexity.

Comparison to the Current USAC Working Draft

In the following, proposed text changes for a technical description of the current USAC working draft will be discussed. In order to incorporate the proposed inventive changes according to the present invention, the following sections need to be updated:

In the pending definition of "payloads for audio object type USAC", in which the syntax of the so-called ICS information is described, the conventional syntax should be replaced by the syntax shown in FIG. 10*b*.

Also, the "data element" "window_sequence" should be replaced by the following definition of the data elements "window_length" and "transform_length":

window length: a one-bit field that determines which window slope length is used for the right-hand part of this window sequence; and transform_length: a one-bit field that determines which transform length is used for this window sequence.

In addition, the definition of the help element "window_sequence" should be added as follows:

window_sequence: indicates the sequence of windows as defined by the "window_length" of the previous frame, the "transform_length" and the "window length" of the current frame and the "core_mode" of the following frame, according to the table shown in FIG. 8.

FIG. 8 shows the definition of the help element "window_sequence", which may optionally be derived from the "window_length" information of the previous frame, the "window_length" information of the current frame, the "transform_length" information of the current frame and the "core mode" information of the following frame.

Moreover, the conventional definition of the "window_sequence" and the "window_shape" may be replaced by the more appropriate definitions of "window_length", "transform_length" and "window_shape" as follows:

window_length: a one-bit field that determines which window slope length is used for the right-hand part of this window;

transform_length: a one-bit field that determines which transform length is used for this window; and window_shape: one-bit indicating which window function is selected.

Figure 11:
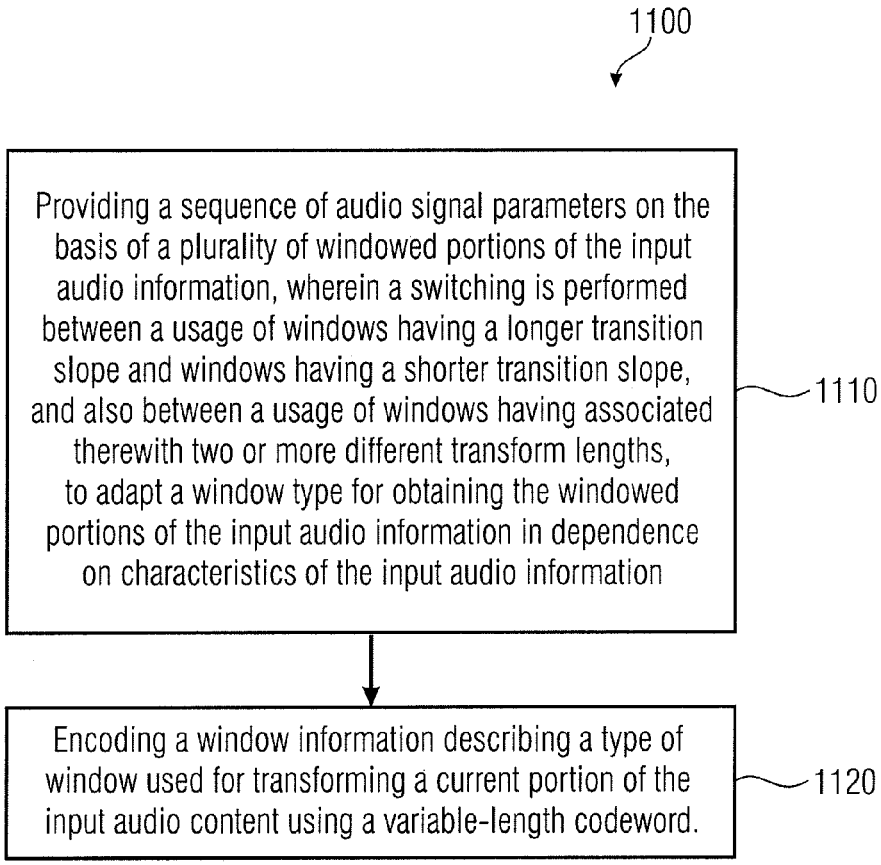
FIG. 11 shows a flowchart of a method for providing an encoded audio information on the basis of an input audio information.

Method According to FIG. 11

FIG. 11 shows a flowchart of a method for providing an encoded audio information on the basis of an input audio information. The method 1100 according to FIG. 11 comprises a step 1110 of providing a sequence of audio signal parameters on the basis of a plurality of windowed portions of the input audio information. When providing the sequence of audio signal parameters, a switching is performed between a usage of windows having a longer transition slope and windows having a shorter transition slope, and also between a usage of windows having associated therewith two or more different transform lengths, in order to adapt a window type for obtaining the windowed portions of the input audio information in dependence on characteristics of the input audio information. The method 1100 also comprises a step 1120 of encoding a window information describing a type of window used for transforming a current portion of the input audio information using a variable-length-codeword.

Figure 12:
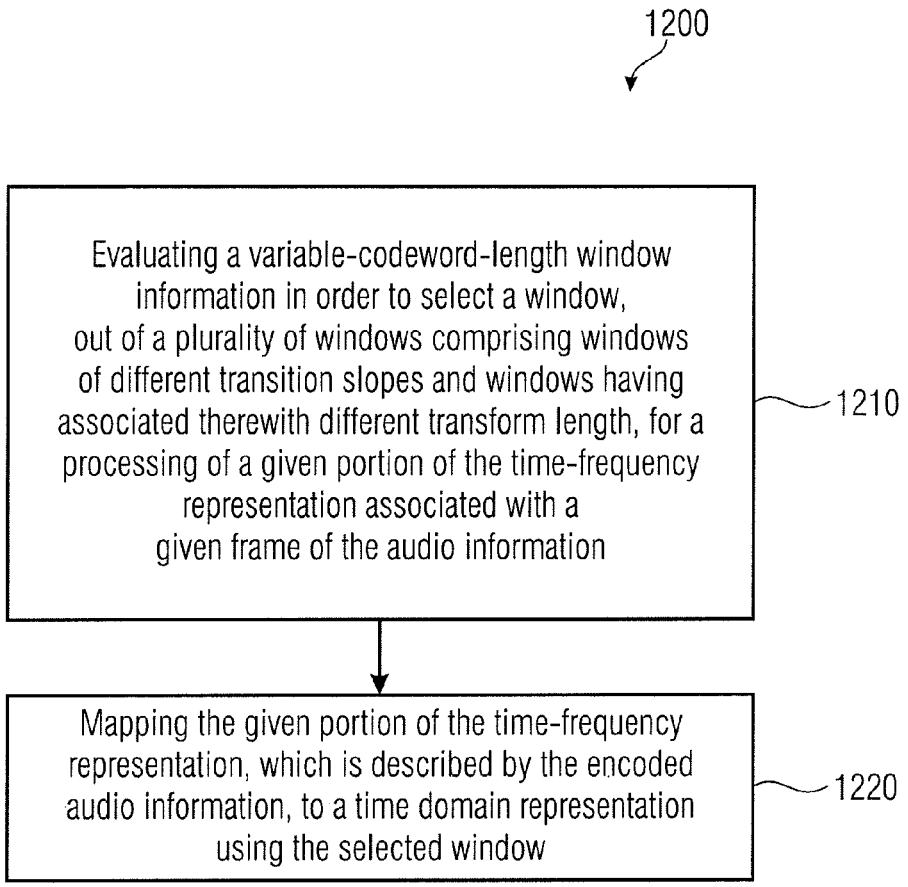
FIG. 12 shows a flowchart of a method for providing a decoded audio information on the basis of an encoded audio information.

Method According to FIG. 12

FIG. 12 shows a flowchart of a method for providing a decoded audio information on the basis of an encoded audio information. The method 1200 according to FIG. 12 comprises a step 1210 of evaluating a variable-codeword-length window information in order to select a window, out of a plurality of windows comprising windows of different transition slopes and windows having associated therewith different transform lengths, for a processing of a given portion of the time-frequency representation associated with a given frame of the audio information. The method 1200 also comprises a step 1220 of mapping the given portion of the time-frequency representation, which is described by the encoded audio information, to a time-domain representation using the selected window.

It should be noted that the methods according to FIGS. 11 and 12 can be supplemented by any of the features and functionalities described herein with respect to the inventive apparatuses and the inventive bitstream characteristics.

IMPLEMENTATION ALTERNATIVES

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Any of the steps of the inventive method can be performed using a microprocessor, a programmable computer, an fpga or any other hardware, like, for example, a data processing hardware.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio decoder for providing a decoded audio information on the basis of an encoded audio information, the audio decoder comprising:

a window-based signal transformer configured to map a time-frequency representation of the audio information, which is described by the encoded audio information, to a time-domain representation of the audio information, wherein the window-based signal transformer is configured to select a window, out of a plurality of windows comprising windows of different transition slopes and windows having associated therewith different transform lengths using a window information;

wherein the audio decoder comprises a window selector configured to evaluate a variable-codeword-length window information in order to select a window for a processing of a given portion of the time-frequency representation associated with a given frame of the audio information;

wherein the audio decoder is implemented using a hardware apparatus, or using a computer, or using a combination of a hardware apparatus and a computer.

2. The audio decoder according to claim 1, wherein the audio decoder comprises a bitstream parser configured to parse a bitstream representing the encoded audio information and to extract from the bitstream a one-bit window-slope-length information ("window_length") and to selectively extract, in dependence on a value of the one-bit window-slope-length information, a one-bit transform-length information ("transform_length"); and wherein the window selector is configured to selectively, in dependence on the window-slope-length information, use or neglect the transform-length information in order to select a window type for a processing of a given portion of the time-frequency representation.

3. The audio decoder according to claim 1, wherein the window selector is configured to select a window type for a processing of a current portion of the time-frequency information, such that a left-sided window-slope-length of the window for processing the current portion of the time-frequency representation is matched to a right-sided window-slope-length of a window used for processing a previous portion of the time-frequency representation.

4. The audio decoder according to claim 3, wherein the window selector is configured to select between a first type of window and a second type of window in dependence on a value of the one-bit window-slope-length information, if a right-sided window-slope-length of the window for processing the previous portion of the time-frequency representation takes a long value and if a previous portion of the audio information, a current portion of the audio information and a subsequent portion of the audio information are all encoded using a frequency-domain core mode;

wherein the window selector is configured to select a third type of window in response to a first value of the one-bit window-slope-length information indicating a long right-sided window slope, if a right-sided window-slope-length of the window for processing a previous portion of the audio information takes a short value and if the previous portion of the audio information, the current portion of the audio information and the subsequent portion of the audio information are all encoded using a frequency-domain core mode; and wherein the window selector is configured to select between a fourth type of window and a fifth type of window, which defines a short-window-sequence, in dependence on a one-bit transform-length information, if the one-bit window-slope-length information takes a second value indicating a short right-sided window slope, if the right-sided window-slope-length of the window for processing the previous portion of the audio information takes a short value and if the previous portion of the audio information, the current portion of the audio information and the subsequent portion of the audio information are all encoded using a frequency-domain core mode;

wherein the first type of window comprises a comparatively long left-sided window-slope-length, a comparatively long right-sided window-slope-length and a comparatively long transform-length;

wherein the second window type comprises a comparatively long left-sided window-slope-length, a comparatively short right-sided window-slope-length and a comparatively long transform-length;

wherein the third window type comprises a comparatively short left-sided window-slope-length, a comparatively long right-sided window-slope-length and a comparatively long transform length;

wherein the fourth window type comprises a comparatively short left-sided window-slope-length, a comparatively short right-sided window-slope-length and a comparatively long transform length; and wherein the window sequence of the fifth window type defines a superposition of a plurality of windows associated to a single portion of the audio information, and wherein each of the windows of the plurality of windows comprises a comparatively short transform length, a comparatively short left-sided window slope and a comparatively short right-sided window slope.

5. The audio decoder according to claim 1, wherein the window selector is configured to selectively evaluate a transform-length bit of the variable-codeword-length window information of a current portion of the audio information only if a window type for a processing of a previous portion of the audio information comprises a right-sided window-slope-length matching a left-sided window-slope-length of a window-sequence of short windows and a one-bit window-slope-length information associated with a current portion of the time-frequency representation defines a right-sided window-slope-length matching the right-sided window-slope-length of the window-sequence of short windows.

6. The audio decoder according to claim 1, wherein the window selector is further configured to receive a previous core mode information associated with a previous frame of the audio information and describing a core mode for encoding the previous frame of the audio information; and wherein the window selector is configured to select a window type for a processing of a current portion of the time-frequency representation in dependence on the previous core mode information and also in dependence on the variable-codeword-length window information associated to the current portion of the audio information.

7. The audio decoder according to claim 1, wherein the window selector is further configured to receive a subsequent core mode information associated with a subsequent portion of the audio information and describing a core mode for encoding the subsequent portion of the audio information; and wherein the window selector is configured to select a window for a processing of a current portion of the audio information in dependence on the subsequent core mode information and also in dependence on the variable-codeword-length window-information associated to the current portion of the time-frequency representation.

8. The audio decoder according to claim 7, wherein the window selector is configured to select windows comprising a shortened right-sided slope, if the subsequent core mode information indicates that a subsequent portion of the audio information is encoded using a linear-prediction-domain core mode.

9. An audio encoder for providing an encoded audio information on the basis of an input audio information, the audio encoder comprising:

a window-based signal transformer configured to provide a sequence of audio signal parameters on the basis of the plurality of windowed portions of the input audio information, wherein the window-based signal transformer is configured to adapt window types for acquiring the windowed portions of the input audio information in dependence on characteristics of the input audio information;

wherein the window-based signal transformer is configured to switch between a usage of windows comprising a longer transition slope and windows comprising a shorter transition slope, and to also switch between a usage of windows comprising two or more different transform lengths;

and wherein the window-based signal transformer is configured to determine a window type used for transforming a current portion of the input audio information in dependence on a window type used for transforming a preceding portion of the input audio information and an audio content of the current portion of the input audio information;

wherein the audio encoder is configured to encode a window information describing a type of window used for transforming the current portion of the input audio information using a variable-length-codeword;

wherein the audio encoder is implemented using a hardware apparatus, or using a computer, or using a combination of a hardware apparatus and a computer.

10. The audio encoder according to claim 9, wherein the audio encoder is configured to provide the variable-length-codeword such that the variable-length-codeword associated with a given portion of the time-frequency representation comprises a single-bit information describing a window-slope-length of a window applied for acquiring the given portion of the time-frequency representation; and wherein the audio encoder is configured to provide the variable-length-codeword such that the variable-length-codeword selectably comprises a single-bit transform-length information describing a transform-length applied for acquiring the given portion of the time-frequency representation if, and only if, the single-bit information describing the window-slope-length takes a predetermined value.

11. The audio encoder according to claim 9, wherein the audio encoder is configured to encode a window-slope-length information describing a right-sided window-slope-length of a window applied to acquire a given portion of the time-frequency representation and a transform-length information describing a transform length applied for acquiring the given portion of the time-frequency representation using separate bits of the bitstream, and to decide about the presence of a bit carrying the transform-length information in dependence on the value of the window-slope-length information.

12. A method of encoding an audio information, the method comprising:

an encoded time-frequency representation describing an audio content of a plurality of windowed portions of an audio signal, wherein windows of different transition slopes and different transform lengths are associated with different of the windowed portions of the audio signal; and an encoded window information encoding types of windows used for acquiring the encoded time-frequency representation of a plurality of windowed portions of the audio signal, wherein the encoded window information is a variable-length window information encoding one or more types of windows using a first, lower number of bits and encoding one or more other types of windows using a second, larger number of bits.

13. The method of encoding an audio information according to claim 12, wherein the encoded audio information comprises one-bit window-slope-length information units associated with corresponding windowed portions of an audio signal encoded using a frequency-domain core mode; and one-bit transform-length information units selectively associated with windowed portions of the audio signal for which the one-bit window-slope-length information takes a predetermined value.

14. A method for providing a decoded audio information on the basis of an encoded audio information, the method comprising:

evaluating a variable-codeword-length window information in order to select a window, out of a plurality of windows comprising windows of different transition slopes and windows having associated therewith different transform lengths, for processing a given portion of a time-frequency representation associated with a given frame of the audio information; and mapping the given portion of the time-frequency representation, which is described by the encoded audio information, to a time-domain representation using the selected window.

15. A method for providing an encoded audio information on the basis of an input audio information, the method comprising:

providing a sequence of audio signal parameters on the basis of a plurality of windowed portions of the input audio information, wherein a switching is performed between a usage of windows comprising a longer transition slope and windows comprising a shorter transition slope, and also between a usage of windows having associated therewith two or more different transform lengths, to adapt window types for acquiring the windowed portions of the input audio information in dependence on characteristics of the input audio information; and encoding an information describing types of windows used for transforming portions of the input audio information using variable-length-codewords.

16. A non-transitory digital storage medium comprising a computer program for performing the method for providing a decoded audio information on the basis of an encoded audio information, the method comprising:

evaluating a variable-codeword-length window information in order to select a window, out of a plurality of windows comprising windows of different transition slopes and windows having associated therewith different transform lengths, for processing a given portion of a time-frequency representation associated with a given frame of the audio information; and mapping the given portion of the time-frequency representation, which is described by the encoded audio information, to a time-domain representation using the selected window, when the computer program runs on a computer.

17. A non-transitory digital storage medium comprising a computer program for performing the method for providing an encoded audio information on the basis of an input audio information, the method comprising:

providing a sequence of audio signal parameters on the basis of a plurality of windowed portions of the input audio information, wherein a switching is performed between a usage of windows comprising a longer transition slope and windows comprising a shorter transition slope, and also between a usage of windows having associated therewith two or more different transform lengths, to adapt window types for acquiring the windowed portions of the input audio information in dependence on characteristics of the input audio information; and encoding an information describing types of windows used for transforming portions of the input audio information using variable-length-codewords, when the computer program runs on a computer.

18. An audio decoder for providing a decoded audio information on the basis of an encoded audio information, the audio decoder comprising:

a window-based signal transformer configured to map a time-frequency representation of the audio information, which is described by the encoded audio information, to a time-domain representation of the audio information, wherein the window-based signal transformer is configured to select a window, out of a plurality of windows comprising windows of different transition slopes and windows having associated therewith different transform lengths using a variable codeword length window information, which encodes one or more types of windows using a first, lower number of bits and encodes one or more other types of windows using a second, larger number of bits, and which is included in the encoded audio information;

wherein the audio decoder comprises a window selector configured to evaluate the variable-codeword-length window information in order to select a window for a processing of a given portion of the time-frequency representation associated with a given frame of the audio information;

wherein the audio decoder is implemented using a hardware apparatus, or using a computer, or using a combination of a hardware apparatus and a computer.

19. An audio encoder for providing an encoded audio information on the basis of an input audio information, the audio encoder comprising:

a window-based signal transformer configured to provide a sequence of audio signal parameters on the basis of the plurality of windowed portions of the input audio information, wherein the window-based signal transformer is configured to adapt window types for acquiring the windowed portions of the input audio information in dependence on characteristics of the input audio information;

wherein the window-based signal transformer is configured to switch between a usage of windows comprising a longer transition slope and windows comprising a shorter transition slope, and to also switch between a usage of windows comprising two or more different transform lengths;

and wherein the window-based signal transformer is configured to determine a window type used for transforming a current portion of the input audio information in dependence on a window type used for transforming a preceding portion of the input audio information and an audio content of the current portion of the input audio information;

wherein the audio encoder is configured to encode a window information describing a type of window used for transforming the current portion of the input audio information using a variable-length-codeword, which encodes one or more types of windows using a first, lower number of bits and encodes one or more other types of windows using a second, larger number of bits;

wherein the audio encoder is implemented using a hardware apparatus, or using a computer, or using a combination of a hardware apparatus and a computer.

20. A method for providing a decoded audio information on the basis of an encoded audio information, the method comprising:

evaluating a variable-codeword-length window information, which encodes one or more types of windows using a first, lower number of bits and encodes one or more other types of windows using a second, larger number of bits, and which is included in the encoded audio information, in order to select a window, out of a plurality of windows comprising windows of different transition slopes and windows having associated therewith different transform lengths, for processing a given portion of a time-frequency representation associated with a given frame of the audio information; and mapping the given portion of the time-frequency representation, which is described by the encoded audio information, to a time-domain representation using the selected window;

wherein the method is performed using a hardware apparatus, or using a computer, or using a combination of a hardware apparatus and a computer.

21. A method for providing an encoded audio information on the basis of an input audio information, the method comprising:

providing a sequence of audio signal parameters on the basis of a plurality of windowed portions of the input audio information, wherein a switching is performed between a usage of windows comprising a longer transition slope and windows comprising a shorter transition slope, and also between a usage of windows having associated therewith two or more different transform lengths, to adapt window types for acquiring the windowed portions of the input audio information in dependence on characteristics of the input audio information; and encoding an information describing types of windows used for transforming portions of the input audio information using variable-length-codewords, which encode one or more types of windows using a first, lower number of bits and encode one or more other types of windows using a second, larger number of bits;

wherein the method is performed using a hardware apparatus, or using a computer, or using a combination of a hardware apparatus and a computer.

* * * * *

UNITED STATES PATENT AND TRADEMARK OFFICE

CERTIFICATE OF CORRECTION

PATENT NO. : 8,762,159 B2
APPLICATION NO. : 13/191246
DATED : June 24, 2014
INVENTOR(S) : Ralf Geiger et al.

It is certified that error appears in the above-identified patent and that said Letters Patent is hereby corrected as shown below:

On the Title Page, Item (73) Assignee:

Fraunhofer-Gesellschaft zur Foederung der Angewandten Farshung E.V.

should read:

Fraunhofer-Gesellschaft zur Foerderung der angewandten Forschung e.V.

Signed and Sealed this
Sixteenth Day of June, 2015

Michelle K. Lee

Michelle K. Lee
*Director of the United States Patent and Trademark Office*